US010421089B2

(12) United States Patent
Kase

(10) Patent No.: US 10,421,089 B2
(45) Date of Patent: Sep. 24, 2019

(54) DISCHARGE CONTAINER FOR DISCHARGING CONTENTS ONTO DISCHARGE SURFACE

(71) Applicant: Mai Kase, Tokyo (JP)

(72) Inventor: Mai Kase, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/065,205

(22) PCT Filed: Dec. 22, 2016

(86) PCT No.: PCT/JP2016/088571
§ 371 (c)(1),
(2) Date: Jun. 22, 2018

(87) PCT Pub. No.: WO2017/111130
PCT Pub. Date: Jun. 29, 2017

(65) Prior Publication Data

US 2019/0001355 A1 Jan. 3, 2019

(30) Foreign Application Priority Data

Dec. 25, 2015 (JP) ..... 2015-253536
Dec. 25, 2015 (JP) ..... 2015-254159
Sep. 30, 2016 (JP) ..... 2016-192553

(51) Int. Cl.
*B05B 9/04* (2006.01)
*B65D 83/14* (2006.01)
*B65D 83/20* (2006.01)

(52) U.S. Cl.
CPC ..... *B05B 9/04* (2013.01); *B65D 83/14* (2013.01); *B65D 83/20* (2013.01)

(58) Field of Classification Search
CPC ..... B05B 9/04; B65D 83/14; B65D 83/20
(Continued)

(56) References Cited

U.S. PATENT DOCUMENTS 4,341,348 A 7/1982 Dearling
5,385,303 A 1/1995 Gosselin et al.
(Continued)

FOREIGN PATENT DOCUMENTS

GB 1170341 A 11/1969
GB 2220989 A 1/1990
(Continued)

OTHER PUBLICATIONS

Feb. 7, 2017 International Search Report issued in International Patent Application No. PCT/JP2016/088571.
(Continued)

*Primary Examiner* — Lien M Ngo
(74) *Attorney, Agent, or Firm* — Oliff PLC

(57) ABSTRACT

A discharge container includes: a container body in which contents are stored; a securing member; a discharger including a stem; an exterior portion that includes a top wall portion through which a molded hole passes, and that discharges the contents from the molding hole onto a discharge surface of the top wall portion; and an inner plate in the exterior section to be movable and which forms a diffusion chamber between the inner plate and a supply surface of the top wall portion.

13 Claims, 23 Drawing Sheets

(58) Field of Classification Search
USPC ..... 222/402.14, 402.13–402.15, 402.11
See application file for complete search history.

(56) References Cited

U.S. PATENT DOCUMENTS

| | | | | | |
|---|---|---|---|---|---|
| 5,692,846 | A * | 12/1997 | Schwarzberg | A47L 23/05 | 401/190 |
| 5,813,785 | A * | 9/1998 | Baudin | B65D 83/285 | 401/190 |
| 6,283,337 | B1 * | 9/2001 | Nakamura | B65D 83/285 | 222/402.1 |
| 7,905,673 | B2 * | 3/2011 | Swaile | A61K 8/046 | 222/402.1 |
| 9,440,056 | B2 * | 9/2016 | Hofland | A61M 35/003 | |

FOREIGN PATENT DOCUMENTS

| | | | |
|---|---|---|---|
| JP | S61-55959 | U | 4/1986 |
| JP | H01-103554 | U | 7/1989 |
| JP | 2002-080080 | A | 3/2002 |
| JP | 2013-256316 | A | 12/2013 |
| JP | 2016-050002 | A | 4/2016 |
| JP | 2017-013895 | A | 1/2017 |

OTHER PUBLICATIONS

Jul. 22, 2019 Extended Search Report issued in European Patent Application No. 16879016.0.

* cited by examiner

DISCHARGE CONTAINER FOR DISCHARGING CONTENTS ONTO DISCHARGE SURFACE

TECHNICAL FIELD

The present invention relates to a discharge container for discharging contents onto a discharge surface. Priority is claimed on Japanese Patent Applications No. 2015-253536, filed Dec. 25, 2015, No. 2015-254159, filed Dec. 25, 2015, and No. 2016-192553, filed Sep. 30, 2016, the content of which is incorporated herein by reference.

BACKGROUND ART

Conventionally, for example, a discharge container as shown in the following Patent Document 1 is known. This discharge container includes a container main body in which contents are stored, a discharger having a stem capable of discharging contents by moving downward with respect to the container main body, a fixing member attached to a mouth portion of the container main body, and a movable member provided at the fixing member to be movable downward and having a discharge hole for discharging the contents discharged by the stem. The movable member includes a locking portion that is locked to the stem and moves down the stem as the movable member moves downward. In this discharge container, when the movable member is pushed down against the fixing member, the movable member is locked to the fixing member in a state in which the locking portion moves down the stem. Therefore, the contents can be continuously discharged from the discharge hole.

Conventionally, for example, a discharge container as shown in the following Patent Document 2 is known. The discharge container has a saucer that stores liquid (contents) suctioned up above an internal piston. A communication hole communicating with the internal piston and a receiving plate located above the communication hole are provided in the saucer. The receiving plate is connected to a circumferential edge of the communication hole via a plurality of fixing legs provided at intervals in a circumferential direction of the communication hole. A liquid outlet hole which discharges the liquid suctioned up above the internal piston to an upper surface (discharge surface) of the saucer is formed between adjacent fixed legs in the circumferential direction. A plurality of liquid outlet holes are formed to be separated from each other in the circumferential direction by the plurality of fixed legs.

Conventionally, a discharge container as shown in the following Patent Document 3 is known. The discharge container includes a container body in which contents are stored, a discharger having a stem provided upright to be movable downward in a state where the stem is pushed upward, an exterior portion having a shaping surface and a plurality of molding holes, and an inner plate provided in the exterior portion to be vertically movable, and when the inner plate moves down with respect to the exterior portion, a diffusion chamber is formed between the inner plate and the exterior portion. Then, a plurality of shaped pieces are formed by the contents diffusing from the stem into the diffusion chamber and then the contents being discharged through the plurality of molding holes to the shaping surface, and a molded object can be formed by combining the respective shaped pieces.

CITATION LIST

Patent Documents

[Patent Document 1]
Japanese Unexamined Patent Application, First Publication No. 2002-80080
[Patent Document 2]
Japanese Unexamined U. M. Application, First Publication No. H1-103554
[Patent Document 3]
Japanese Unexamined Patent Application, First Publication No. 2016-50002

SUMMARY OF INVENTION

Technical Problem

However, in conventional discharge containers, there is a problem that it is difficult to separate the fixing member from the container main body.

Further, in conventional discharge containers, since a plurality of liquid outlet holes are separated from each other in the circumferential direction by the fixed legs, variation in the discharge amount of the contents which are discharged from the communication hole and pass separately through the plurality of liquid outlet holes and are then discharged onto the upper surface of the saucer easily occurs with respect to respective positions in the circumferential direction. When the discharge amount of the contents discharged onto the upper surface of the saucer varies with respect to respective positions in the circumferential direction, for example, the discharge speed of the contents may locally increase in a part in the circumferential direction and the contents may unintentionally overflow from the saucer or the like.

In addition, the inventor of the present application has found out that there are the following two problems as a result of intensive study. Firstly, Patent Document 3 discloses a constitution in which the exterior portion and the inner plate are provided to be integrally rotatable about a container axis and are moved down integrally by rotating them. Due to such a constitution, it is possible to improve the operability. On the other hand, when discharge of the contents from the stem is stopped, the inner plate is then moved up with a time lag, and additional contents in the diffusion chamber are discharged onto the shaping surface. Accordingly, the flow of the contents discharged from the molding holes becomes discontinuous, and thus the accuracy of the shape of the molded object may decrease. Secondly, Patent Document 3 discloses a constitution in which the inner plate is disposed to be movable downward in a state where the inner plate is pushed upward and the inner plate is directly pushed down. Due to such a constitution, the discharge of contents from the stem is stopped by stopping pushing down the inner plate, and the inner plate itself is moved up by an upward pushing force, and thus the contents in the diffusion chamber are discharged onto the shaping surface. Therefore, the flow of the contents discharged from the molding holes can be made continuous, but the amount of the contents discharged onto the shaping surface is greatly influenced by a length of an operation time when pushing down the inner plate. Accordingly, there is room for improvement regarding the shaping precision of the molded object.

The present invention has been made in view of the above problems, and it is an object of the present invention to provide a discharge container in which a fixing member is able to be easily detached from a container main body, variation in a discharge amount of contents discharged onto a discharge surface at respective positions is able to be minimized and a molded object is able to be formed on the discharge surface (shaping surface) with high precision while operability is improved.

Solution to Problem

In order to achieve the aforementioned objects, the present invention proposes the following means. According to a first aspect of the present invention, there is provided a discharge container including: a container main body in which contents are stored; a fixing member attached to a mouth portion of the container main body; a discharger including a stem provided upright in the mouth portion of the container main body to be movable downward in a state where the stem is pushed upward; an exterior portion including a top wall portion which is disposed above the stem and through which a molding hole passes in a vertical direction, and the exterior portion configured to discharge the contents from the discharge hole to a discharge surface of the top wall portion facing upward; and an inner plate provided in the exterior portion to be movable and configured to form a diffusion chamber between the inner plate and a supply surface of the top wall portion that faces downward, the diffusion chamber configured to diffuse the contents from the stem in a radial direction and supply the contents to the molding hole. In the discharge container, the fixing member includes an outer fitting cylinder externally fitted to the mouth portion of the container main body, a surrounding cylinder surrounding the outer fitting cylinder from an outer side in the radial direction, and a plurality of connecting portions connecting the outer fitting cylinder with the surrounding cylinder and disposed with a gap in a circumferential direction, and the gap passes through the fixing member in a vertical direction. The exterior portion includes a circumferential wall portion extending downward from the top wall portion and is inserted into a space between the outer fitting cylinder and the surrounding cylinder of the fixing member. A lower engaging portion, which is engaged with an upper engaging portion formed on an inner circumferential surface of the surrounding cylinder from a lower side of the upper engaging portion, is formed on an outer circumferential surface of the circumferential wall portion. A locking portion, which is configured to be locked to the stem and to move down the stem as the inner plate moves downward, and a pushing-down portion, which protrudes toward an outside in the radial direction and is disposed on an outside of the exterior portion through an insertion hole formed in the circumferential wall portion of the exterior portion, are provided at the inner plate. And, the lower engaging portion is disposed on an outer circumferential surface of the circumferential wall portion of the exterior portion at a position in the circumferential direction which avoids a position in the circumferential direction where the pushing-down portion is disposed, and protrudes toward the outside in the radial direction.

According to the first aspect, when the pushing-down portion is pulled up, the exterior portion is also pulled up, and the lower engaging portion of the exterior portion is caught by the upper engaging portion of the fixing member from a lower side of the upper engaging portion, and a pulling-up force applied to the pushing-down portion is propagated to the outer fitting cylinder via the connecting portion of the fixing member, and a large force is locally exerted toward an outer side in the radial direction at a connection portion of the outer fitting cylinder with the connecting portion. Therefore, it is possible to deform the outer fitting cylinder over the entire circumference with the connection portion as a starting point, and the fixing member can be detached from the mouth portion of the container main body. Accordingly, for example, it is possible to replace the container main body as necessary after use of the contents in the container main body is finished. Further, the lower engaging portion is disposed on the outer circumferential surface of the circumferential wall portion of the exterior portion at the position in the circumferential direction which avoids the position in the circumferential direction where the pushing-down portion is disposed. Therefore, it is possible to prevent the lower engaging portion of the exterior portion from interfering with the pushing-down portion when the inner plate is assembled from the lower portion of the exterior portion on the exterior portion. Further, the pushing-down portion that is pushed down when the contents are discharged is provided in the inner plate that is different from the exterior portion having the discharge surface (shaping surface) on which the contents are discharged. Therefore, it is possible to discharge the contents without touching the discharge surface of the exterior portion and to prevent the contents from adhering to the hands, and it is also possible to minimize wobbling of the exterior unit and to prevent the contents from overflowing from the discharge surface. Also, since the contents in the container body diffuse in the radial direction in the diffusion chamber and are then supplied to the molding holes, it is possible to minimize concentration of the contents on a molding hole disposed in a specific part on the discharge surface and to supply the contents to the molding holes with less variation. Accordingly, it is possible to minimize variation in a discharge amount of the contents discharged onto the discharge surface at respective positions.

A second aspect of the present invention is a discharge container according to the first aspect where: the lower engaging portion extends in the circumferential direction and is divided by the insertion hole in the circumferential direction; and positions in the circumferential direction of both end portions of the pushing-down portion in the circumferential direction and positions in the circumferential of portions where the lower engaging portion and the upper engaging portion are engaged with each other are adjacent to each other. According to the second aspect, the positions in the circumferential direction of both end portions of the pushing-down portion in the circumferential direction and positions in the circumferential direction of portions where the lower engaging portion and the upper engaging portion are engaged with each other are adjacent to each other. Therefore, it is possible to directly transmit the pulling-up force applied to the pushing-down portion to the portion where the lower engaging portion and the upper engaging portion are engaged with each other without dispersing the pulling-up force on the circumferential wall portion of the exterior portion, and thus a large local force can be effectively applied to the connection portion of the outer fitting cylinder toward the outside in the radial direction.

A third aspect of the present invention is a discharge container according to the first or second aspect where: one of the plurality of connecting portions is disposed at a position which at least a part thereof overlaps the pressing-down portion in the vertical direction. According to the third aspect, at least a part of one of the plurality of connecting portions overlaps the pushing-down portion in the vertical direction. Therefore, it is easy to preferentially transmit the pulling-up force applied to the pushing-down portion to one of the plurality of connecting portions, and thus a large local force can be effectively applied to the connection portion toward the outside in the radial direction.

A fourth aspect of the present invention is a discharge container according to any one of the first to third aspect where: the upper engaging portion is located inside a space between the connecting portions adjacent to each other in the circumferential direction in a plan view seen in the vertical direction. According to the fourth aspect, since the upper engaging portion and the connecting portion do not overlap in the plan view seen in the vertical direction, when the fixing member having the connecting portion and the upper engaging portion is molded, the vertical direction can simply be set as a direction of withdrawing a mold. Accordingly, it is possible to easily form the fixing member without complicating a mold structure.

A fifth aspect of the present invention is a discharge container including: an inner plate attached to an upper end portion of a stem provided upright in a mouth portion of a container main body to be movable downward in a state where the stem is pushed upward; and an exterior portion including a plurality of molding holes through which contents discharged from the upper end portion pass and a discharge surface in which the plurality of molding holes are open, the exterior portion configured to form a molded object by combining a plurality of shaped pieces on the discharge surface, the plurality of shaped pieces formed by the contents passing through the plurality of molding holes and being molded. In the discharge container, a diffusion chamber, which diffuses the contents discharged from the upper end portion in a radial direction along the discharge surface and supplies the contents to each of the plurality of molding holes, is configured to be provided between the inner plate and the exterior portion. The exterior portion includes a top wall portion disposed above the stem and through which the plurality of molding holes pass in a vertical direction. The inner plate is provided in the exterior portion to be movable in the vertical direction between an upper standby position where a supply surface of the top wall portion directed to a lower side is in contact with or close to the inner plate and a lower discharge position where the inner plate is separated downward from the supply surface and forms the diffusion chamber between the inner plate and the exterior portion. And, a locking portion, which is configured to be locked to the stem when the inner plate is located at the discharge position and to move down the stem as the inner plate moves downward, is disposed on the inner plate.

According to the fifth aspect, the inner plate is moved down from the position located at the standby position to the discharge position, and the diffusion chamber is formed between the exterior portion and the inner plate, and the locking portion of the inner plate is locked to the stem. When the inner plate is moved further down, the locking portion moves down the stem against the upward pushing force as the inner plate moves down, and the contents in the container main body are supplied to the diffusion chamber through the stem. Then, the contents diffuse in the radial direction in the diffusion chamber, and then are supplied to the molding holes and discharged from the molding holes to the shaping surface. Thereafter, the mounting portion is moved up, the stem is restored upward and displaced, and the inner plate is restored and displaced to the standby position. At this time, since the inner plate is in contact with or close to the supply surface, even if the contents remain in the diffusion chamber before the inner plate is moved up, the contents are pushed out from the diffusion chamber to the outside. According to this discharge container, since the contents in the discharge container are supplied to the molding holes after diffusing in the radial direction in the diffusion chamber, it is possible to minimize the concentration of the contents on the molding holes disposed in a specific part of the discharge surface and to supply the contents to the molding holes so that variation in the supply amount of the contents with respect to the respective molding holes is reduced. Therefore, it is possible to minimize variation in the discharge amount of the contents discharged onto the discharge surface at each position. Also, since the contents remaining in the diffusion chamber can be pushed out from the diffusion chamber by restoring the inner plate to the standby position, it is possible to reduce a residual amount of the contents in the exterior section. For example, it is possible to make it easy to keep the inside of the exterior portion clean by reducing the remaining amount of contents in the exterior section.

A sixth aspect of the present invention is a discharge container including: a container main body in which contents are stored; a fixing member attached to a mouth portion of the container main body; a discharger including a stem provided upright in the mouth portion to be movable downward in a state where the stem is pushed upward; and an exterior portion including a top wall portion disposed above the stem and through which a discharge hole passes in a direction of a container axis, and the exterior portion attached to the fixing member and configured to discharge the contents from the discharge hole to a discharge surface of the top wall portion facing upward. In the discharge container, the fixing member includes an outer fitting cylinder externally fitted to the mouth portion and a surrounding cylinder surrounding the outer fitting cylinder from an outer side in the radial direction. The exterior portion includes a circumferential wall portion which extending downward from the top wall portion and inserted into a space between the outer fitting cylinder and the surrounding cylinder. A lower engaging portion, which is engaged with an upper engaging portion formed on an inner circumferential surface of the surrounding cylinder from a lower side of the upper engaging portion, is formed on an outer circumferential surface of the circumferential wall portion. Guide surfaces, which collide with and come into sliding contact with each other due to relative rotational movement of the exterior portion and the fixing member and move up the exterior portion with respect to the fixing member, are respectively formed at the fixing member and the circumferential wall portion. And, a locking portion, which is configured to be locked to the stem and to move down the stem, and a diffusion chamber, which is disposed on an inside of the circumferential wall portion, a part of a wall surface of which is formed by a supply surface of the top wall portion directed to a lower side, and which is configured to diffuse the contents from the stem in a radial direction and supply the contents to the discharge hole, are provided at the exterior portion.

According to the sixth aspect, when the contents are discharged, the locking portion is locked to the stem and moves down the stem against the upward pushing force, and thus the contents in the container main body flow into the diffusion chamber through the stem. The contents flowing into the diffusion chamber diffuse in the radial direction in the diffusion chamber, are supplied to the molding holes, and are discharged from the molding holes onto the discharge surface (shaping surface). When the exterior portion is detached from the fixing member, the exterior portion and the fixing member are relatively rotated in the circumferential direction. At this time, the guide surfaces of the fixing member and the circumferential wall portion collide with and come into sliding contact with each other and move up the exterior portion with respect to the fixing member. Then, the lower engaging portion climbs over the upper engaging portion, and the engagement between the upper engaging portion and the lower engaging portion is released. After the exterior portion is detached from the fixing member, the exterior part can be cleaned. Therefore, it is possible to maintain clean molding holes and to discharge the contents with high precision and smoothly through the molding holes. In addition, when the contents in the container main body are exhausted, the exterior portion is detached from the fixing member, and then the exterior portion can be reused by attaching the exterior portion to another container body (fixing member). Alternatively, the container main body from which the exterior portion has been detached may be refilled with contents, and the discharge container can be reused by attaching the exterior portion to the discharge container again.

Further, according to the sixth aspect, when the contents are discharged, the contents in the container main body are supplied to the molding holes after diffusing in the radial direction in the diffusion chamber. Therefore, it is possible to minimize the concentration of the contents in a molding hole disposed in a specific part of the discharge surface and to supply the contents to the molding holes with less variation. Thus, it is possible to minimize variation in the discharge amount of the contents discharged onto the discharge surface at each position. Further, the engagement between the upper engaging portion and the lower engaging portion can be released by relatively rotating the exterior portion and the fixing member in the circumferential direction. Therefore, operability of separating the exterior portion from the fixing member can be enhanced. By improving this operability, the exterior portion can be easily cleaned and can be easily reused.

A seventh aspect of the present invention is a discharge container according to the sixth aspect where: the guide surfaces are integrally formed with the upper engaging portion and the lower engaging portion, respectively.

According to the seventh aspect, since the guide surfaces are integrally formed with the upper engaging portion and the lower engaging portion respectively, for example, it is possible to simplify the structure thereof.

An eighth aspect of the present invention is a discharge container according to the seventh aspect where: a circumferential end portion of one of the upper engaging portion and the lower engaging portion includes a guide protrusion including a first guide surface as the guide surface and provided to protrude from the circumferential end portion in the direction of the container axis; and a circumferential end portion of the other one of the upper engaging portion and the lower engaging portion is a second guide surface as the guide surface.

According to the eighth aspect, the guide protrusion including the first guide surface is provided at the circumferential end portion of one of the upper engaging portion and the lower engaging portion, and the circumferential end portion of the other one of the upper engaging portion and the lower engaging portion is the second guide surface. Therefore, when the guide surfaces of the fixing member and the circumferential wall portion are in sliding contact with each other, the guide protrusion can receive the force in the circumferential direction that the first guide surface receives from the second guide surface. Further, the force in the circumferential direction that the second guide surface receives from the first guide surface can be received by the upper engaging portion or the lower engaging portion (the engagement portion having the second guide surface). Therefore, it is possible to stably move up the exterior portion with respect to the fixing member.

A ninth aspect of the present invention is a discharge container according to any one of the sixth to eighth aspects where: a pair of guide surfaces as the guide surfaces are provided on the fixing member and the circumferential wall portion to be located on opposite sides in the radial direction with the container axis interposed there between.

According to the ninth aspect, the pair of guide surfaces serving as the guide surfaces are provided on the fixing member and the circumferential wall portion to be located on opposite sides in the radial direction with the container axis interposed therebetween. Therefore, when the exterior portion and the fixing member are rotated with respect to each other in the circumferential direction, the guide surfaces of the fixing member and the circumferential wall portion can be brought into mutual collision at each position on the opposite sides in the radial direction with the container axis interposed therebetween. Therefore, it is possible to move up the exterior portion more stably with respect to the fixing member.

A tenth aspect of the present invention is a discharge container according to any one of the sixth to ninth aspects where: restricting surfaces, which collide with each other in the circumferential direction due to the relative rotational movement of the exterior portion and the fixing portion, and are locked to each other, and restrict further rotational movement thereof, are formed at the fixing member and the circumferential wall portion, respectively; and when the exterior portion rotates toward one side with respect to the fixing member in the circumferential direction, the guide surfaces collide with each other, and when the exterior portion rotates toward the other side with respect to the fixing member in the circumferential direction, the restricting surfaces collide with each other.

According to the tenth aspect, when the exterior portion rotates toward the other side in the circumferential direction with respect to the fixing member, the restricting surfaces collide with each other. Therefore, for example, even when a user rotates the exterior portion and the fixing member in the directions opposite to the directions for detaching the exterior portion from the fixing member while the user detaches the exterior portion from the fixing member, rotation thereof is restricted. Accordingly, it is possible to allow the user to easily recognize a fact that the exterior portion and the fixing member are being rotated in the wrong direction, and it is easy to improve the operability.

An eleventh aspect of the present invention is a discharge container including: a container body including a container main body in which contents are stored; a discharger including a stem provided upright in a mouth portion of the container main body to be movable downward in a state where the stem is pushed upward; an exterior portion including a top wall portion disposed above the stem and through which a molding hole passes in a direction of a container axis, the exterior portion configured to discharge the contents from the discharge hole to a discharge surface of the top wall portion facing upward; and an inner plate disposed in the exterior portion to be movable downward in a state where the inner plate is pushed upward, the inner plate configured to be movable in a vertical direction between an upper standby position where a supply surface of the top wall portion directed to a lower side is in contact with or close to the inner surface and a lower discharge position where the inner plate is separated downward from the supply surface and forms a diffusion chamber between the inner plate and the exterior portion, the diffusion chamber configured to diffuse the contents from the stem in a radial direction and supply the contents to the molding hole. In the discharge container, a locking portion, which is configured to be locked to the stem when the inner plate is located at the discharge position and to move down the stem as the inner plate moves downward, is formed on the inner plate. A pushing member, which pushes the inner plate located at the discharge position upward, is disposed between the container body and the inner plate. The exterior portion and the inner plate are provided to be integrally rotatable around the container axis with respect to the container body. And, at one of the inner plate and the container body, a guide protrusion portion, on which a sliding protrusion portion provided on the other one of the inner plate and the container body slides in a circumferential direction around a center of the container axis and moves down the inner plate against an upward pushing force of the pushing member, and a relief portion, which is adjacent to the guide protrusion portion in the circumferential direction and allows the sliding protrusion portion having climbed over the guide protrusion portion in the circumferential direction to move upward, are provided.

According to the eleventh aspect, the exterior portion and the inner plate are integrally rotatable about the container axis with respect to the container body, and the inner plate is moved down by sliding the sliding protrusion portion and the guiding protrusion portion provided on the inner plate and the container body slide in the circumferential direction. Therefore, the inner plate is moved down by rotating the exterior portion around the container axis with respect to the container body, and the locking portion formed in the inner plate moves down the stem, diffuses the contents in the radial direction in the diffusion chamber, and then discharges the contents through the molding holes onto the shaping surface. Further, the relief portion circumferentially adjacent to the guide protrusion portion allows the movement of the sliding protrusion portion to climb over the guide protrusion portion toward the upper side in the circumferential direction. Therefore, the inner plate is moved up to the standby position due to the upward pushing force by rotating the exterior portion by a predetermined amount, so that the discharge of the contents from the stem is stopped and the contents in the diffusion chamber can be pushed out to the shaping surface. In this way, it is possible to discharge the contents from the stem by the operation of rotating the exterior portion around the container axis with respect to the container body and to stop the discharge from the stem, and thus it is possible to restore the inner plate to the standby position. Therefore, for example, when comparing with a case in which the contents are discharged from the stem by pushing down the inner plate with the hand, an operating force is reduced, the discharge amount of the contents is stabilized, and the flow of the contents discharged onto the shaping surface while the contents are being discharged from the stem, and the flow of the contents discharged to the shaping surface while the discharge from the stem is stopped and the contents in the diffusion chamber are pushed out to the shaping surface are continuous. Accordingly, it is possible to shape the molded object with high accuracy.

A twelfth aspect of the present invention is a discharge container according to the eleventh aspect where: the container body includes an inner cylindrical portion fixed to the mouth portion of the container body, a receiving portion extending toward an inside from the inner cylindrical portion in the radial direction, and an external conversion cylindrical portion extending upward from an inner circumferential edge of the receiving portion; an internal conversion cylindrical portion, which extends downward in an inner side of the external conversion cylindrical portion in the radial direction, is formed at the inner plate; and the guide protrusion portion is provided at one of the external conversion cylindrical portion and the internal conversion cylindrical portion, and the sliding protrusion portion is provided at the other one of the external conversion cylindrical portion and the internal conversion cylindrical portion.

According to the twelfth aspect, the receiving portion which receives an elastic force of the pushing member extends toward the inside in the radial direction from the inner cylindrical portion fixed to the mouth portion of the container body, and the external conversion cylindrical portion extends upward from the inner circumferential edge of the receiving portion. Due to such a constitution, since rigidities of the receiving portion and the external conversion cylindrical portion are increased and deformation or displacement of the external conversion cylindrical portion is minimized by the elastic force of the pushing member, it is possible to stabilize a positional relationship between the sliding protrusion portion and the guide protrusion portion. Therefore, it is possible to reliably achieve excellent effects with the sliding protrusion portion and the guide protrusion portion as described above, and the pushing member and the external conversion cylindrical portion can be disposed compactly inside the mouth portion of the container main body.

A thirteenth aspect of the present invention is a discharge container according to the eleventh or twelfth aspect where: the guide protrusion portion includes a first vertical surface extending in the direction of the container axis and a first inclined surface gradually separated from the first vertical surface toward one side in the circumferential direction as going upward from the first vertical surface; the sliding protrusion portion includes a second vertical surface extending in the direction of the container axial and a second inclined surface gradually separated from the second vertical surface toward the other side in the circumferential direction as going downward; and an angle formed by the first vertical surface and the first inclined surface and an angle formed by the second vertical surface and the second inclined surface are the same as each other.

According to the thirteenth aspect, the angle formed by the first vertical surface and the first inclined surface of the guide protrusion portion and the angle formed by the second vertical surface and the second inclined surface of the sliding protrusion portion are equal to each other. Therefore, it is possible to increase a contact area between the first inclined surface and the second inclined surface when the sliding protrusion portion slides on the guide protrusion portion in the circumferential direction. Therefore, for example, when the sliding protrusion portion and the guide protrusion portion slide, it is possible to minimize wear of them, thereby stabilizing the operation. Furthermore, both the guide protrusion portion and the slide protrusion portion have a vertical surface extending in the direction of the container axial. Therefore, rotation around the container axis with respect to the exterior portion and the container body of the inner plate is allowed in only one direction, and the sliding protrusion portion which reaches the relief portion can be quickly moved upward by the upward pushing force of the pushing member. Accordingly, it is possible to improve the operability when the exterior portion is rotated with respect to the container body and to stabilize the speed and amount of contents discharged onto the shaping surface, and thus it is possible to more reliably improve the molding accuracy of the molded object.

Advantageous Effects of Invention

According to the present invention, it is possible to provide a discharge container capable of easily separating a fixing member from a container main body, minimizing variation in a discharge amount of contents discharged onto a discharge surface at each position and forming a molded object on the discharge surface (shaping surface) with high precision while improving operability.

DESCRIPTION OF EMBODIMENTS

First Embodiment

Hereinafter, a discharge container according to a first embodiment of the present invention will be described with reference to the drawings.

Figure 1:
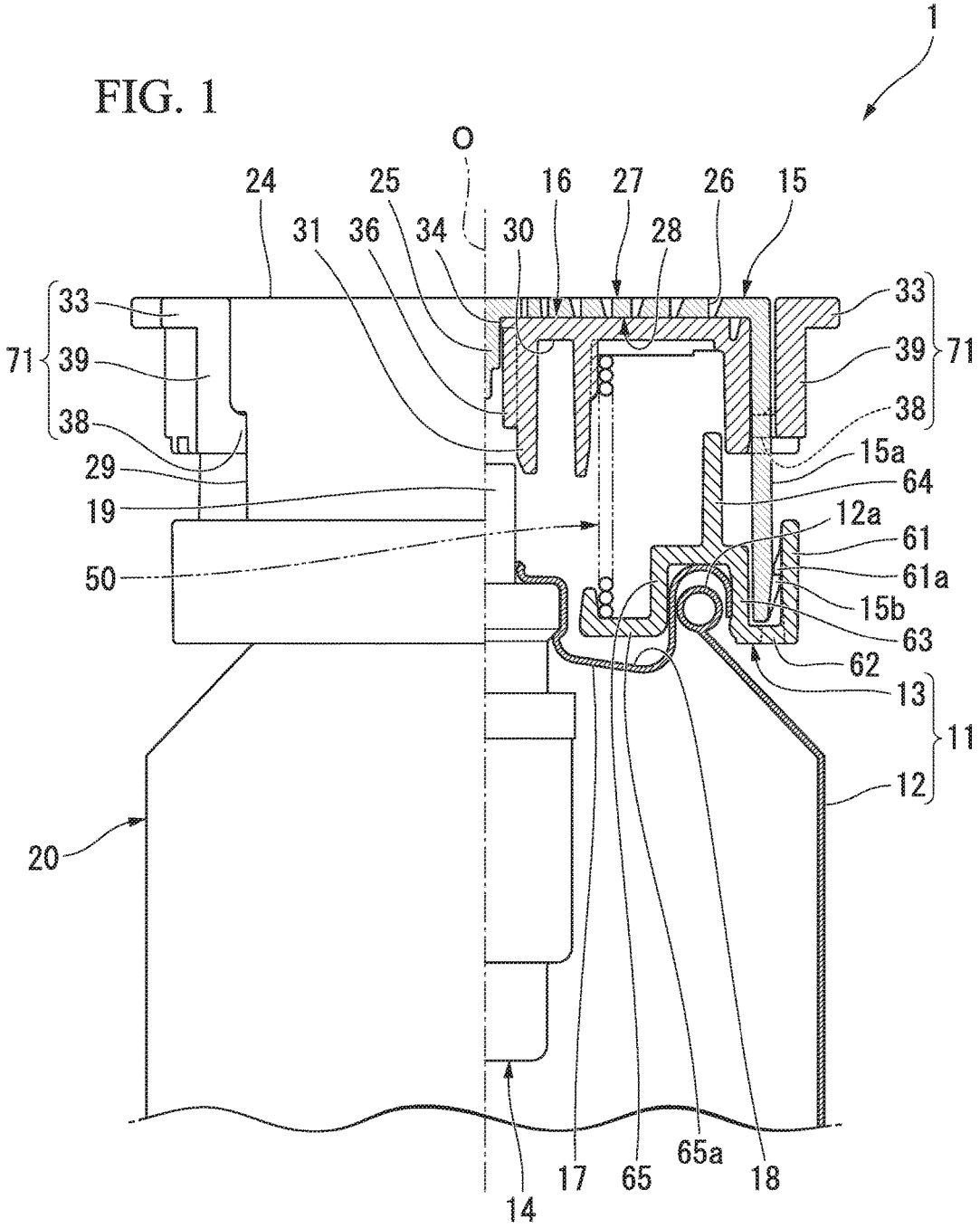
FIG. 1 is a longitudinal half sectional view of a main part of a discharge container according to a first embodiment of the present invention, and is a view showing a state in which an inner plate is located at a standby position.
Figure 2:
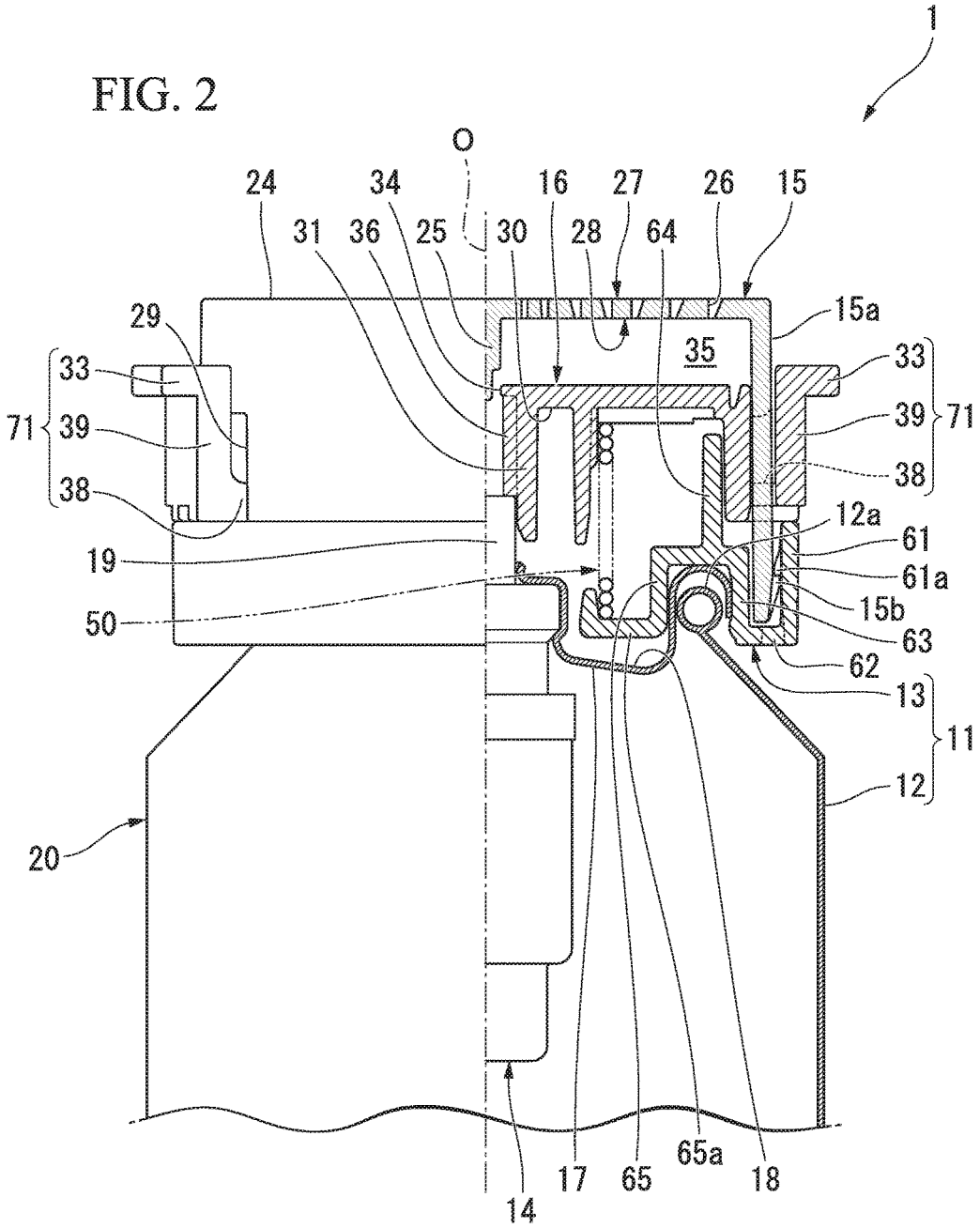
FIG. 2 is a longitudinal half sectional view of the main part of the discharge container shown in FIG. 1, and is a view showing a state in which the inner plate is moved down to a discharge position.

As shown in FIGS. 1 and 2, a discharge container 1 includes a container body 11, a discharger 14, an exterior portion 15, and an inner plate 16. The discharge container 1 discharges contents that can hold its shape for at least a certain time after discharge such as a foamed material or a highly viscous material. The container body 11 includes a container main body 12 in which the contents are stored, and a fixing member 13 attached to a mouth portion 12*a* of the container main body 12.

Here, in the embodiment, the container main body 12 is formed in a cylindrical shape with a bottom, and the exterior portion 15 is formed in a cylindrical shape with a top, and central axes thereof are disposed on a common axis. Hereinafter, the common axis is referred to as a container axis O, a side of the bottom of the container main body 12 in a direction along the container axis O is referred to as a lower side, a side of the mouth portion 12*a* of the container main body 12 in the direction along the container axis O is referred to as an upper side, and the direction along the container axis O is referred to as a vertical direction. In a top view of the discharge container 1, a direction orthogonal to the container axis O is referred to as a radial direction, and a direction of circling around the container axis O is referred to as a circumferential direction.

The inside of the container main body 12 is hermetically sealed by covering the mouth portion 12*a* with a top wall 17. An annular concave portion 18 extending in the circumferential direction is provided in the top wall 17. The annular concave portion 18 is recessed downward.

The discharger 14 includes a stem 19 provided upright in the mouth portion 12*a* of the container main body 12 to be movable downward in a state that the stem 19 is biased upward. The stem 19 is disposed coaxially with the container axis O and is formed to have a diameter that is smaller than that of the annular concave portion 18. The stem 19 passes through the top wall 17 in the vertical direction. In the inside of the discharger 14, a discharge valve, which is not shown, is provided in a portion thereof located inside the container main body 12.

When the stem 19 is pushed down with respect to the container main body 12, the discharge valve opens, and the contents in the container main body 12 pass through the stem 19 and are discharged from an upper end portion of the stem 19. At this time, in the embodiment, for example, the foamy contents in the container main body 12 are discharged from the upper end portion of the stem 19. When the pushing down of the stem 19 is released, the stem 19 is moved upward due to an upward pushing force acting on the stem 19, the discharge valve is closed, and the discharge of the contents is stopped. The container main body 12 and the discharger 14 described above constitute a discharge container main body 20 which discharges the contents stored in the container main body 12 from the stem 19. In the shown example, an aerosol can in which liquid contents are accommodated is adopted as the discharge container main body 20.

The fixing member 13 includes an outer fitting cylinder 63 externally fitted to the mouth portion 12*a* of the container main body 12, a surrounding cylinder 61 which surrounds the outer fitting cylinder 63 from the outside in the radial direction, and a plurality of connecting portions 62 which connect the outer fitting cylinder 63 to the surrounding cylinder 61 and are disposed at intervals in the circumferential direction.

Figure 5:
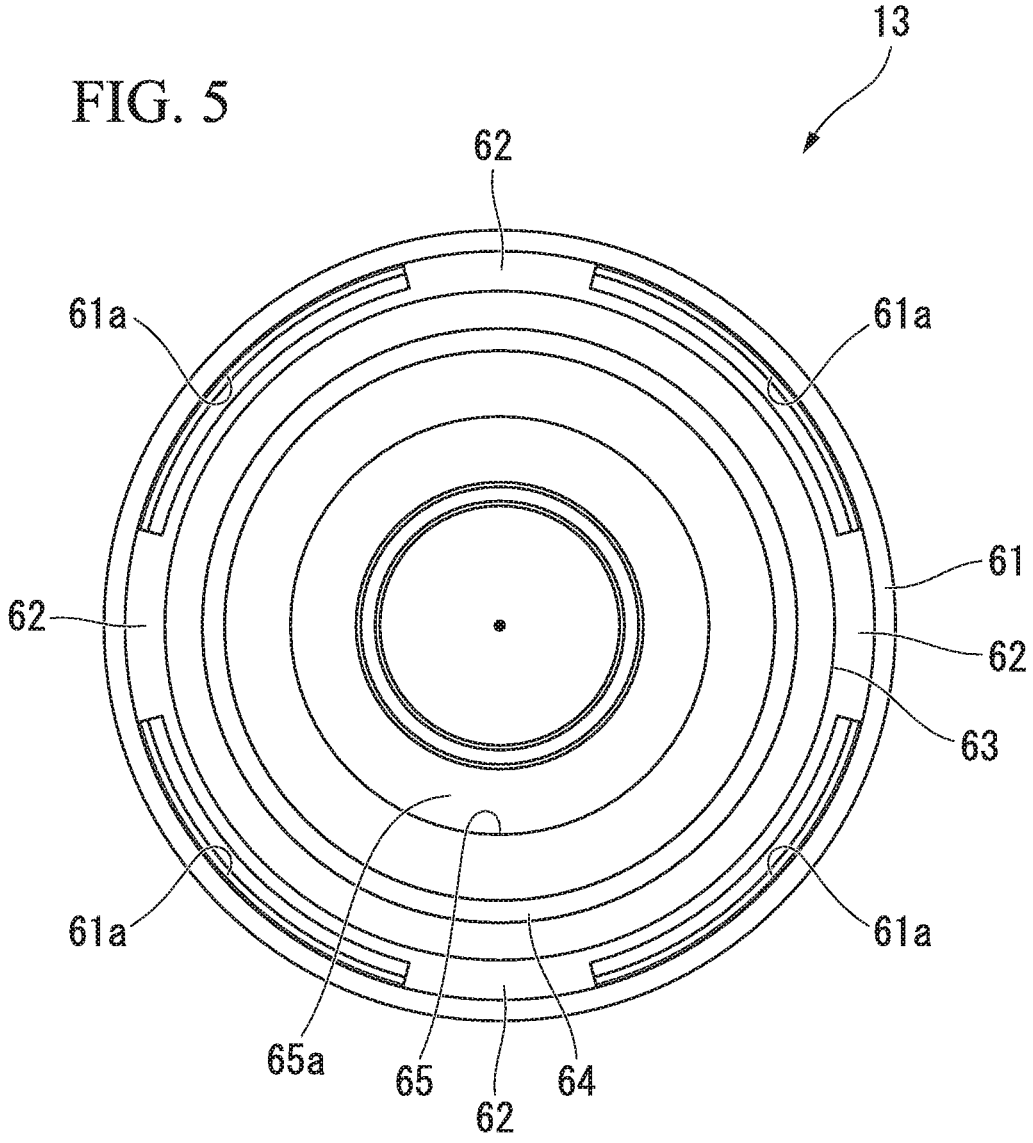
FIG. 5 is a top view of a fixing member of the discharge container shown in FIG. 1.

As shown in FIG. 5, a top view shape of the surrounding cylinder 61 and the outer fitting cylinder 63 is a circular shape that is coaxial with the container axis O. On an inner circumferential surface of the surrounding cylinder 61, a plurality of upper engaging portions 61*a* that extend in the circumferential direction are formed at intervals in the circumferential direction. The plurality of upper engaging portions 61*a* protrude toward the inside in the radial direction from the inner circumferential surface of the surrounding cylinder 61. The plurality of upper engaging portions 61*a* are formed in a protruding shape extending in the circumferential direction. The connecting portions 62 connect the surrounding cylinder 61 with the outer fitting cylinder 63 in the radial direction. The top view shape of the connecting portion 62 is a rectangular shape that is long in the circumferential direction. The connecting portions 62 are disposed at regular intervals in the circumferential direction. The circumferential length of the connecting portion 62 is shorter than the circumferential length of a space between adjacent connecting portions 62 in the circumferential direction. Further, the space between the connecting portions 62 penetrates in the vertical direction. The protrusion amount of the upper engaging portion 61*a* from the inner circumferential surface of the surrounding cylinder 61 toward the inside in the radial direction is smaller than a gap in the radial direction between the inner circumferential surface of the surrounding cylinder 61 and an outer circumferential surface of the outer fitting cylinder 63. The circumferential length of the upper engaging portion 61*a* is equal to or shorter than a circumferential length of the space between adjacent connection portions 62 in the circumferential direction. The upper engaging portion 61*a* is located inside the space between adjacent connecting portions 62 in the circumferential direction in a plan view seen in the vertical direction.

In the shown example, the fixing member 13 includes an inner cylindrical portion 65 fitted into the annular concave portion 18 of the top wall 17. The inner cylindrical portion 65 is fitted from the inside in the radial direction into an outer circumferential surface of the annular concave portion 18 facing the inside in the radial direction. A flange portion 65*a* extending toward the inside in the radial direction is formed in the inner cylindrical portion 65. The fixing member 13 has a protruding portion 64 which is formed in a cylindrical shape with a bottom and which connects the outer fitting cylinder 63 with the inner cylindrical portion 65 in the radial direction and protrudes upward. The protruding portion 64 is disposed at a position in which an outer circumferential surface of the protruding portion 64 and an inner circumferential surface of an inner plate main body 30 are close to each other in the radial direction in a discharge state which will be described later.

As shown in FIG. 6, the exterior portion 15 includes a top wall portion 24 disposed above the stem 19 and a circumferential wall portion 15*a* extending downward from an outer circumferential edge of the top wall portion 24. The top wall portion 24 is formed in a plate shape orthogonal to the container axis O. The circumferential wall portion 15*a* is inserted into a space between the outer fitting cylinder 63 and the surrounding cylinder 61 of the fixing member 13. A lower engaging portion 15*b* which protrudes toward the outside in the radial direction and is engaged with the upper engaging portion 61*a* of the surrounding cylinder 61 from the lower side of the upper engaging portion 61*a* is formed on an outer circumferential surface of the circumferential wall portion 15*a*. The circumferential length of the lower engaging portion 15*b* is longer than the circumferential length of the upper engaging portion 61*a*, and the number of lower engaging portions 15*b* is smaller than the number of upper engaging portions 61*a*. The exterior portion 15 is formed in a cylindrical shape with a top disposed coaxially with the container axis O. As shown in FIGS. 1 and 6, a core body 25, molding holes 26, and insertion holes 29 are formed in the exterior portion 15.

The core body 25 extends downward from the top wall portion 24. The core body 25 is disposed coaxially with the container axis O. The core body 25 is located above an upper end edge of the stem 19. An outer diameter of the core body 25 is smaller than an inner diameter of the stem 19, and the core body 25 faces the upper end portion of the stem 19 in the vertical direction. The core body 25 is formed in a solid bar shape or column shape. A reduced diameter portion is formed at a lower end portion of the core body 25.

A plurality of molding holes 26 are formed to pass through the top wall portion 24 of the exterior portion 15 in the vertical direction. Each one of the plurality of molding holes 26 opens to a discharge surface 27 facing an upper side of the top wall portion 24 and to a supply surface 28 facing a lower side of the top wall portion 24. The discharge surface 27 and the supply surface 28 are orthogonal to the container axis O.

The plurality of molding holes 26 are respectively formed in a long hole shape extending in the circumferential direction. The plurality of molding holes 26 are arranged at intervals in the circumferential direction and the radial direction. In the embodiment, the plurality of molding holes 26 arranged at intervals in the circumferential direction form a hole array L1, and hole arrays L1 are arranged at multiple positions around the container axis O. The hole arrays L1 are arranged to surround the core body from the outside in the radial direction in a top view.

Figure 6A:
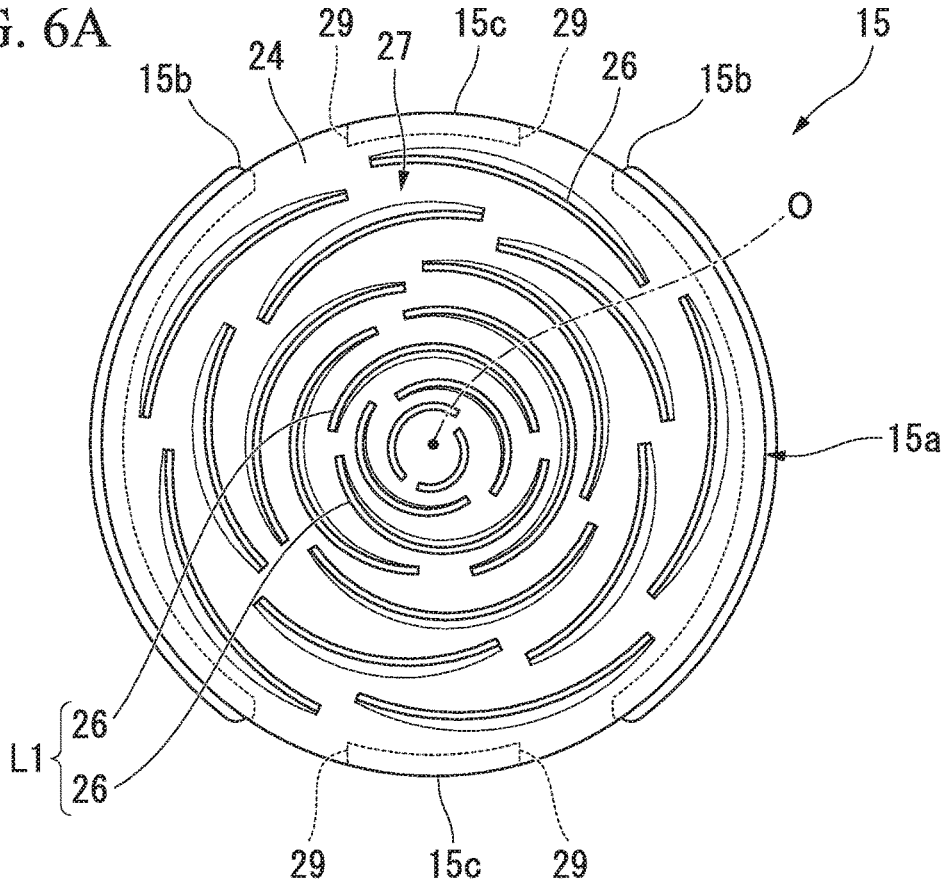
FIG. 6A is a top view of an exterior portion of the discharge container shown in FIG. 1.
Figure 6B:
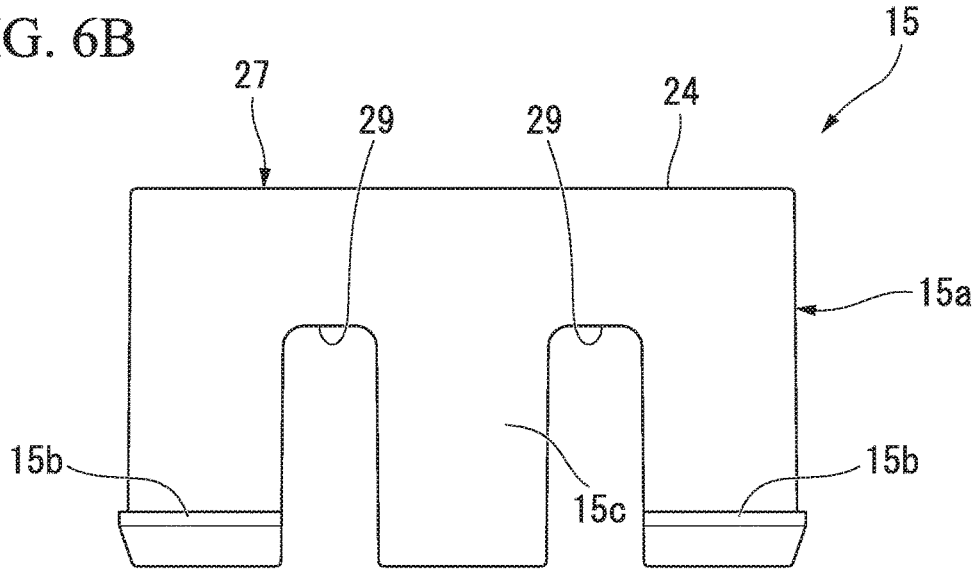
FIG. 6B is a side view of the exterior portion of the discharge container shown in FIG. 1.

As shown in FIGS. 1, 6A and 6B, the insertion hole 29 is formed by notching the circumferential wall portion 15*a* of the exterior portion 15 so that the lower end side of the circumferential wall portion 15*a* opens, and passes through the circumferential wall portion 15*a* in the radial direction. The insertion hole 29 is provided in such a position and dimensions that a pushing-down portion 71 of the inner plate 16 which will be described below can be inserted to protrudes toward the outside of the exterior portion 15. As shown in FIG. 6B, the insertion hole 29 is formed in a rectangular shape which is long in the vertical direction when seen from the outside in the radial direction. In the example shown in the drawing, four insertion holes 29 are formed in the circumferential wall portion 15*a* at intervals in the circumferential direction. These four insertion holes 29 constitute two sets of two. The insertion holes 29 of each one of two sets are formed adjacent to each other in the circumferential direction, and two sets of insertion holes 29 are respectively formed at positions facing each other in the radial direction.

In addition, the lower engaging portion 15*b* formed on the circumferential wall portion 15*a* is divided by the insertion holes 29 in the circumferential direction. The lower engaging portion 15*b* is formed on the outer circumferential surface of the circumferential wall portion 15*a* at a position in the circumferential direction which avoids a position in the circumferential direction where an insertion wall portion 15*c* located between two insertion holes 29 adjacent to each other in the circumferential direction is arranged and a position in the circumferential direction where the insertion holes 29 are arranged. A circumferential end portion of the lower engaging portion 15*b* is located at an opening circumferential edge portion of the insertion holes 29 in the circumferential wall portion 15*a*.

The inner plate 16 is provided to be movable in the vertical direction in the exterior portion 15, and rotational movement of the inner plate 16 with respect to the exterior portion 15 is restricted. The inner plate 16 includes the inner plate main body disposed in the exterior portion 15, a guide cylinder 31 in which the stem 19 moves forward and backward, a locking portion 36 which is locked to the stem 19 and moves down the stem 19 as the inner plate 16 moves down, and the pushing-down portion 71 which protrudes toward the outside in the radial direction. The inner plate main body is formed in a cylindrical shape with a top and is fitted into the exterior portion 15 to be movable in the vertical direction. An outer circumferential surface of the inner plate main body 30 slides on an inner circumferential surface of the exterior portion 15 in the vertical direction. A top view shape of the inner plate main body 30 is formed to have the same shape and the same size as a top view shape of the inner circumferential surface of the exterior portion 15.

A communication hole 34 is formed in the inner plate main body 30. The communication hole 34 passes through the inner plate main body 30 in the vertical direction. The communication hole 34 is disposed coaxially with the container axis O. The communication hole 34 has a larger diameter than that of the core body 25, and the core body 25 is inserted into the communication hole 34. The communication hole 34 has a smaller diameter than an outer diameter of the stem 19. The guide cylinder 31 extends downward from the inner plate main body 30, and the stem 19 moves forward and backward inside the guide cylinder 31. The guide cylinder 31 is disposed coaxially with the container axis O.

The inner plate 16 moves in the vertical direction between an upper standby position in which the inner plate 16 is in contact with or close to the supply surface 28 as shown in FIG. 1 and a lower discharge position in which the inner plate 61 moves down the stem 19 to supply the contents from the stem 19 into a diffusion chamber 35 as shown in FIG. 2. As shown in FIG. 1, when the inner plate 16 is located at the standby position, the core body 25 is inserted into the communication hole 34.

As shown in FIG. 2, in the discharge position, the inner plate 16 moves downward from the supply surface 28 and forms the diffusion chamber 35 between the supply surface 28 and the inner plate 16. The diffusion chamber 35 diffuses the contents from the stem 19 in the radial direction (a direction along the discharge surface 27 and the supply surface 28) between the supply surface 28 and the inner plate 16 so that the contents are supplied into each of the plurality of molding holes 26. The diffusion chamber 35 is disposed coaxially with the container axis O. The diffusion chamber 35 is formed in a flat shape that is larger in the radial direction than in the vertical direction. A part of a wall surface of the diffusion chamber 35 is formed by the supply surface 28.

The locking portion 36 that is locked to the stem 19 and moves down the stem 19 when the inner plate 16 is located at the discharge position is provided on the inner plate 16. The locking portion 36 is located at an opening circumferential edge portion of the communication hole 34 in the inner plate main body 30, comes into contact with the upper end edge of the stem 19 from above, and moves down the stem 19. At this time, the communication hole 34 communicates the inside of the stem 19 with the diffusion chamber 35. At this time, the inner plate main body 30 of the inner plate 16 is located below the core body 25, and the core body 25 is disposed inside the diffusion chamber 35.

As shown in FIG. 1, the pushing-down portion 71 that protrudes toward the outside in the radial direction is provided on the inner plate 16. The pushing-down portion 71 includes a side plate 39 of which a front surface and a back surface extend along an outer circumferential surface of the exterior portion 15, a pushing-down plate 33 which protrudes toward the outside from the side plate 39 in the radial direction and of which front and back surfaces are directed upward and downward, and a coupling plate 38 which connects the side plate 39 with the inner plate main body 30 and is inserted into the insertion hole 29.

The two pushing-down portions 71 are disposed separately at positions which sandwich the container axis O in the radial direction on the outer circumferential surface of the inner plate main body 30. The coupling plate 38 protrudes toward the outside in the radial direction from a lower end portion of the outer circumferential surface of the inner plate main body 30. A plurality of (two in the shown example) coupling plates 38 are disposed with respect to one side plate 39 at intervals in the circumferential direction. The coupling plate 38 connects the inner plate main body 30 with the side plate 39 in a state of being inserted into the insertion hole 29.

As shown in FIG. 1, the coupling plate 38 is in contact with or close to an upper edge which is located at the upper end of the opening circumferential edge of the insertion hole 29 and which faces downward. Further, the coupling plate 38 is in contact with or close to a side edge of the opening circumferential edge portion of the insertion hole 29 which is located at both ends in the circumferential direction and directed in the circumferential direction. Therefore, rotation of the inner plate 16 with respect to the exterior portion 15 is restricted. The side plate 39 is disposed to extend in the vertical direction. The front surface or the back surface of the side plate 39 extends along the outer circumferential surface of the exterior portion 15. The side plate 39 connects the coupling plate 38 with the pushing-down plate 33. In addition, a gap in the radial direction is provided between the side plate 39 and the outer circumferential surface of the inner plate main body 30. The pushing-down plate 33 protrudes toward the outside in the radial direction from the upper end portion of the side plate 39. The front surface and the back surface of the pushing-down plate 33 are directed upward and downward. The front surface of the pushing-down plate 33 is formed to be flush with the discharge surface 27 of the exterior portion 15. The front surface of the pushing-down plate 33 may not be flush with the ejection surface 27.

Here, the insertion wall portion 15*c* of the exterior portion 15 is inserted from the upper side of the inner plate 16 through a radial gap between the side plate 39 and the inner plate main body 30 into a gap between adjacent coupling plates 38 in the circumferential direction. Therefore, the lower engaging portion 15*b* formed on the circumferential wall portion 15*a* of the exterior portion 15 is disposed on the outer circumferential surface of the circumferential wall portion 15*a* at a position in the circumferential direction which avoids a position in the circumferential direction where the pushing-down portion 71 is disposed.

Figure 4:
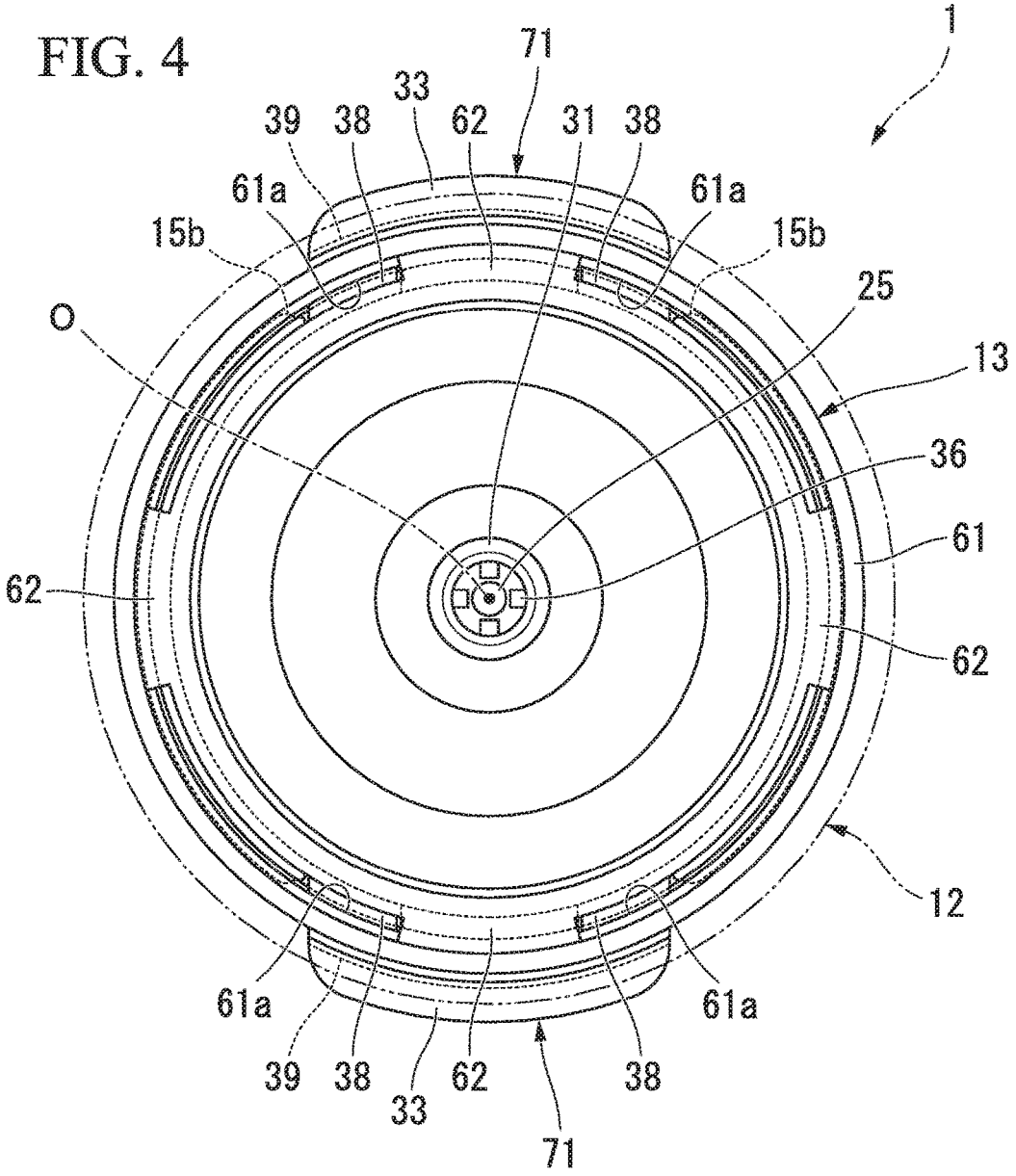
FIG. 4 is a bottom view of the discharge container shown in FIG. 1 in a state in which a container main body is detached therefrom.

Here, in the embodiment, as shown in FIG. 4, one of the plurality of connecting portions 62 is disposed at a position which at least a part thereof overlaps the pushing-down portion 71 in the vertical direction. In the shown example, a center portion of the pushing-down portion 71 in the circumferential direction and a center portion of one of the plurality of connecting portions 62 in the circumferential direction overlap each other in the vertical direction. The center portion of the pushing-down portion 71 in the circumferential direction and the center portion of one of the plurality of connecting portions 62 in the circumferential direction may not completely overlap in the vertical direction, and it suffices that the pushing-down portion 71 and at least a part of one of the plurality of connecting portions 62 overlap in the vertical direction. In addition, a length of the pushing-down portion 71 in the circumferential direction is longer than a length of the connecting portion 62 in the circumferential direction. Further, as shown in FIGS. 4 to 6B, in a plan view seen in the vertical direction, two upper engaging portions 61*a* adjacent to each other in the circumferential direction are engaged with one lower engaging portion 15*b*. Furthermore, all of the plurality of upper engaging portions 61*a* are engaged with the lower engaging portion 15*b*. Additionally, both end portions of the pushing-down portion 71 in the circumferential direction and portions in which the lower engaging portion 15*b* and the upper engaging portion 61*a* are engaged with each other are positioned to be adjacent to each other in the circumferential direction.

As shown in FIGS. 1 and 2, a pushing member 50 formed of a spring member is provided between the fixing member 13 and the inner plate 16. The pushing member 50 moves the inner plate 16 located at the discharge position upward to the standby position. An upper end portion of the pushing member 50 is in contact with a lower surface of the inner plate main body 30, and a lower end portion of the pushing member 50 is in contact with an upper surface of the flange portion 65*a* of the fixing member 13.

Next, an operation of the discharge container 1 according to the present embodiment will be described.

In an initial state before use of the discharge container 1, the inner plate 16 is disposed at the standby position as shown in FIG. 1. Then, as shown in FIG. 2, when the contents are discharged onto the discharge surface 27 of the exterior portion 15, the pushing-down plate 33 is pushed down against a pushing force of the pushing member 50, and thus an internal volume of the diffusion chamber 35 located between the top wall portion 24 of the exterior portion 15 and the inner plate 16 is increased, and the locking portion 36 of the inner plate 16 is locked to the upper end portion of the stem 19.

Further, as the inner plate 16 moves down, the stem 19 locked to the locking portion 36 moves down against the upward pushing force, and thus the contents in the container body 12 flow into the diffusion chamber 35 through the stem 19. The contents which have flowed into the diffusion chamber 35 diffuse in the radial direction in the diffusion chamber 35 between the stem 19 and the supply surface 28 directed downward in the top wall portion 24, and then are supplied to the plurality of molding holes 26 and discharged onto the discharge surface 27 from the molding holes 26.

Here, when the contents pass through the plurality of molding holes 26 and then are molded, a plurality of shaped pieces are formed. These shaped pieces are combined on the discharge surface 27, and thus a molded object is formed. The shaped piece shaped by the molding hole 26 is formed to be long in a direction in which the molding hole 26 extends.

Then, when the pushing-down operation of the pushing-down plate 33 is released, the inner plate 16 moves upward with respect to the exterior portion 15 according to a restoring displacement of the stem 19 that is directed upward. At this time, the internal volume of the diffusion chamber 35 decreases, and the contents which have flowed into the diffusion chamber 35 are pushed out from the diffusion chamber 35 to the exterior through the molding holes 26.

As described above, according to the discharge container 1 of the embodiment, the coupling plate 38 of the pushing-down portion 71 is in contact with or close to the upper edge of the opening circumferential portion of the insertion hole 29. Therefore, when the press portion 71 is pulled up, the exterior portion 15 is also pulled up, and the lower engaging portion 15*b* of the exterior portion 15 is caught by the upper engaging portion 61*a* of the fixing member 13 from the lower side of the upper engaging portion 61*a*, and thus a pulling-up force applied to the pushing-down portion 71 is transmitted to the outer fitting cylinder 63 via the connecting portion 62 of the fixing member 13. Therefore, a large local force is exerted toward the outside in the radial direction at a connection portion of the outer fitting cylinder 63 with the connecting portion 62, it is possible to deform the outer fitting cylinder 63 over the entire circumference thereof with the connection portion as a starting point, and the fixing member 13 can be detached from the mouth portion of the container main body 12. Accordingly, for example, after using of the contents in the container body 12 is finished, if necessary, it is possible to detach the exterior portion 15 and the inner plate 16 together with the fixing member 13 from the container main body 12 and to replace the container main body 12 or the like.

Further, the lower engaging portion 15*b* is disposed on the outer circumferential surface of the circumferential wall portion 15*a* of the exterior portion 15 at the position in the circumferential direction which avoids the position in the circumferential direction where the pushing-down portion 71 is disposed.

Therefore, it is possible to prevent the lower engaging portion 15*b* of the exterior portion from interfering with the pushing-down portion 71 when the inner plate 16 is assembled on the exterior portion 15.

In addition, the pushing-down portion 71 which is pushed down when the contents are discharged is provided in the inner plate 16 different from the exterior portion 15 having the discharge surface 27 on which the contents are discharged. Therefore, it is possible to discharge the contents without touching the discharge surface 27 of the exterior portion 15 and to prevent the contents from adhering to the hands, and it is possible to prevent the exterior portion 15 from wobbling and to prevent the contents from overflowing from the discharge surface 27.

Further, since the contents in the container body 11 diffuse in the radial direction in the diffusion chamber 35 and are then supplied to the molding holes 26, it is possible to minimize concentration of the contents on the molding holes 26 arranged on a specific part on the discharge surface 27 and to supply the contents to the molding hole 26 with less variation. Accordingly, it is possible to minimize variation in the discharge amount of the contents discharged onto the discharge surface 27 at each position.

In addition, the lower engaging portion 15*b* extending in the circumferential direction is divided by the insertion hole 29 through which the pushing-down portion 71 of the inner plate 16 passes, and circumferential positions of both end portions of the pushing-down portion 71 in the circumferential direction and circumferential positions of the portions in which the lower engaging portion 15*b* and the upper engaging portion 61*a* are engaged with each other are adjacent to each other. Therefore, the pulling-up force applied to the pushing-down portion 71 can be directly transmitted to the portion in which the lower engaging portion 15*b* and the upper engaging portion 61*a* are engaged with each other without dispersing the pulling-up force on the circumferential wall portion of the exterior portion 15, and thus a large local force can be effectively applied to the connection portion between the outer fitting cylinder 63 and the connecting portion 62 toward the outside in the radial direction.

At least a part of one of the plurality of connecting portions 62 overlaps the pushing-down portion 71 in the vertical direction. Therefore, it is easy to preferentially transmit the pulling-up force applied to the pushing-down portion 71 to one of the plurality of connecting portions 62, and thus a large local force can be easily applied to the connection portion between the outer fitting cylinder 63 and the connecting portion 62 toward the outside in the radial direction.

Further, the upper engaging portion 61*a* is located inside the space between adjacent connecting portions 62 in the circumferential direction in a plan view seen in the vertical direction, and the upper engaging portion 61*a* and the connecting portion 62 do not overlap in the plan view seen in the vertical direction. Therefore, when the fixing member having the connecting portion 62 and the upper engaging portion 61*a* is molded, the vertical direction may simply be set as a direction of withdrawing from a mold. Accordingly, it is possible to easily form the fixing member 13 without complicating a mold structure.

Further, in the circumferential wall portion 15*a* of the exterior portion 15, the lower engaging portion 15*b* is not formed in the insertion wall portion 15*c* located between adjacent insertion holes 29 in the circumferential direction. Therefore, when the insertion wall portion 15*c* is inserted into a space between adjacent coupling plates 38 in the circumferential direction, it is possible to smoothly insert the insertion wall portion 15*c* without widening the gap in the radial direction between the outer circumferential surface of the inner plate main body 30 and the side plate 39.

Second Embodiment

Next, a second embodiment of the present invention will be described. In the second embodiment, components the same as those in the first embodiment are designated by the same reference numerals, explanation thereof will be omitted, and only different points will be described.

Figure 7:
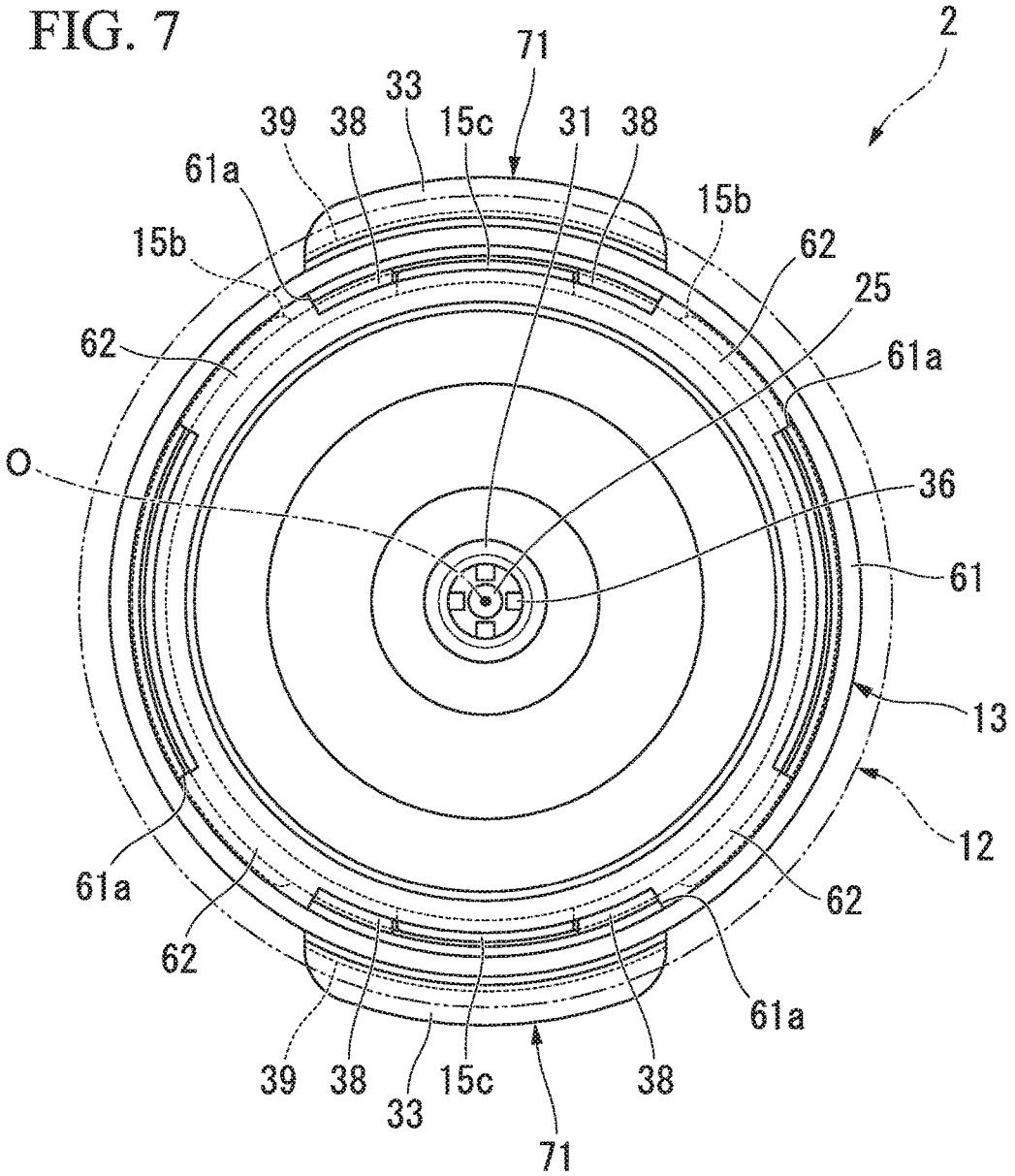
FIG. 7 is a bottom view of a discharge container according to a second embodiment of the present invention in a state in which a container main body is detached.

In a discharge container 2 of the embodiment, as shown in FIG. 7, relative positions of the exterior portion 15 and the inner plate 16 in the circumferential direction are shifted by 45 degrees with respect to the fixing member 13 in the discharge container 1. Therefore, the center portion of the pushing-down portion 71 in the circumferential direction, the space between adjacent connecting portions 62 in the circumferential direction and the center portion of each of the upper engaging portion 61*a* in the circumferential direction overlap each other in the vertical direction. Further, the lower engaging portion 15*b* engages with the upper engaging portion 61*a* located in the center portion of the lower engaging portion 15*b* in the circumferential direction over the entire circumference of the upper engaging portion 61*a* in the circumferential direction. Furthermore, half of the plurality of upper engaging portions 61*a* are not engaged with the lower engaging portion 15*b*. Additionally, the portions in which the lower engaging portion 15*b* and the upper engaging portion 61*a* are engaged with each other are greatly distant from both circumferential end portions of the pushing-down portion 71 in the circumferential direction when comparing with the discharge container 1 of the first embodiment.

Next, a verification test of the above-described actions and effects will be described.

In this verification test, in a state in which the container main body was fixed to a discharge container of a comparative example, the discharge container 1 according to the first embodiment, and the discharge container 2 according to the second embodiment, the circumferential center portion of the pushing-down plate of one pushing-down portion was pulled up. The pulling-up force when the outer fitting cylinder of the fixing member was detached from the mouth portion of the container main body was measured. For the discharge container of the comparative example, a constitution in which the connecting portion was formed on the discharge container 1 over the entire circumference thereof was adopted.

The result was that in the discharge container of the comparative example, a pulling-up force of 110 N or more was necessary, and it was difficult to separate the outer fitting cylinder from the mouth portion. On the other hand, in the discharge containers 1 and 2, it was possible to easily separate the outer fitting cylinder from the mouth portion. Specifically, in the discharge container 1, it was confirmed that the pulling-up force was 56 N to 59 N, and in the discharge container 2, the pulling-up force was 63 N to 66 N. Therefore, in the discharge containers 1 and 2, since a gap is provided between the connecting portions 62 and thus the pulling-up force applied to the pushing-down plate 33 is locally transmitted to the connection portion between the outer fitting cylinder 63 and the connecting portion 62, it was confirmed that the outer fitting cylinder 63 is detached from the mouth portion 12*a* with a pulling-up force less than that in the discharge container of the comparative example. Furthermore, when a circumferential distance from the pushing-down portion 71, on which the pulling-up force is applied, to an engagement portion between the upper engaging portion 61*a* and the lower engaging portion 15*b* is shortened, the pulling-up force applied to the pushing-down plate 33 is reliably transmitted to the engagement portion. Therefore, in the discharge container 1, it was confirmed that the outer fitting cylinder 63 is detached from the mouth portion 12*a* with a pulling-up force less than that in the discharge container 2.

The technical scope of the present invention is not limited to the first and second embodiments, and various modifications can be made without departing from the gist of the present invention.

For example, as the discharge valve of the discharger 14, a quantitative valve in which a certain amount of contents is discharged by a single pushing operation of the stem 19 may be employed. In this case, it is possible to accurately form a molded object formed by combining the contents on the discharge surface 27 via a plurality of molding holes 26A when the contents are discharged onto the discharge surface 27.

Modified Example

Next, a modified example of the first embodiment of the present invention will be described with reference to FIGS. 8 to 11. In this modified example, components the same as those in the first and second embodiments are designated by the same reference numerals, explanation thereof will be omitted, and only different points will be described.

Figure 8:
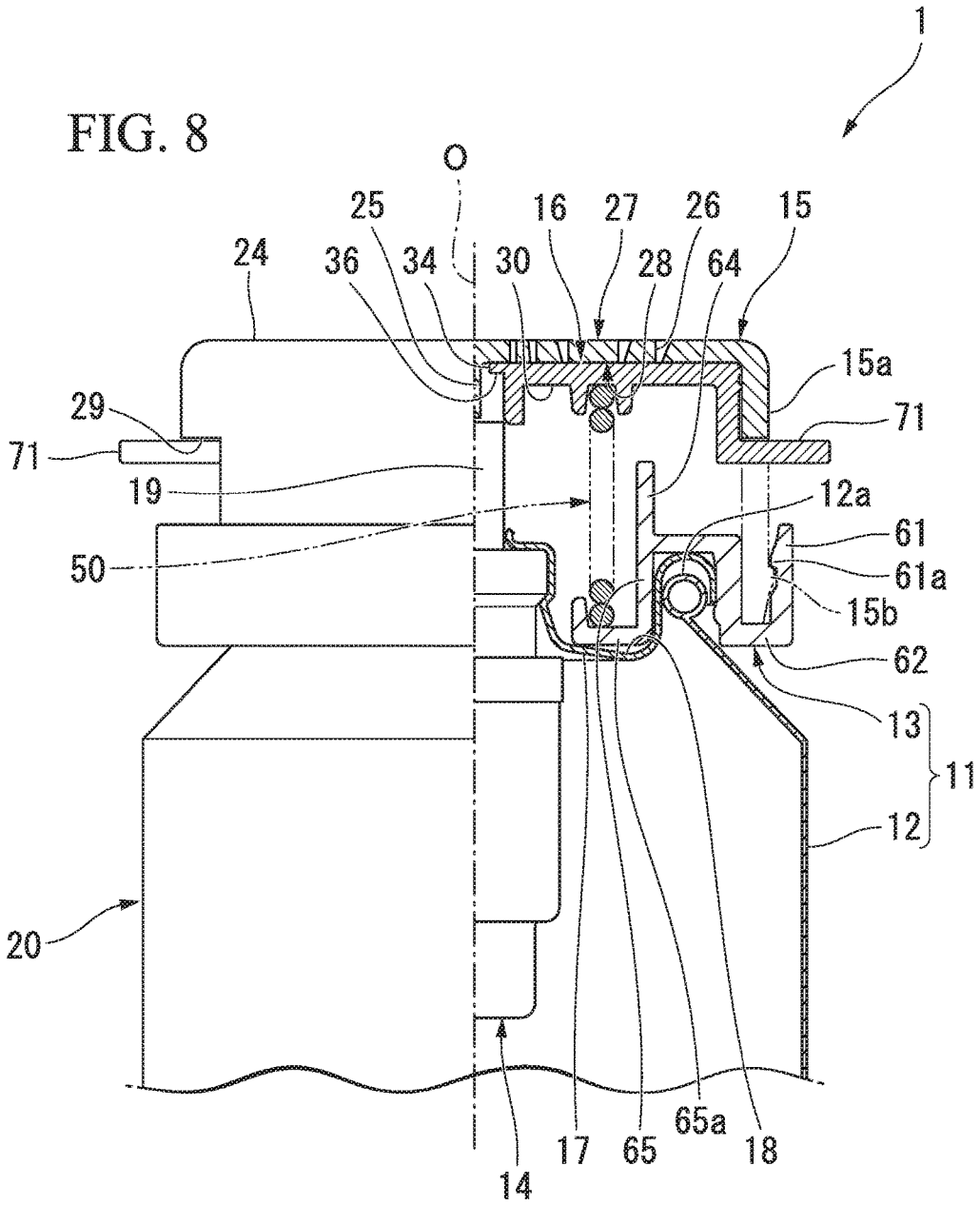
FIG. 8 is a longitudinal half sectional view of a main part of a modified example of the discharge container according to the first and second embodiments of the present invention, and is a view showing a state in which the inner plate is located at the standby position.
Figure 9:
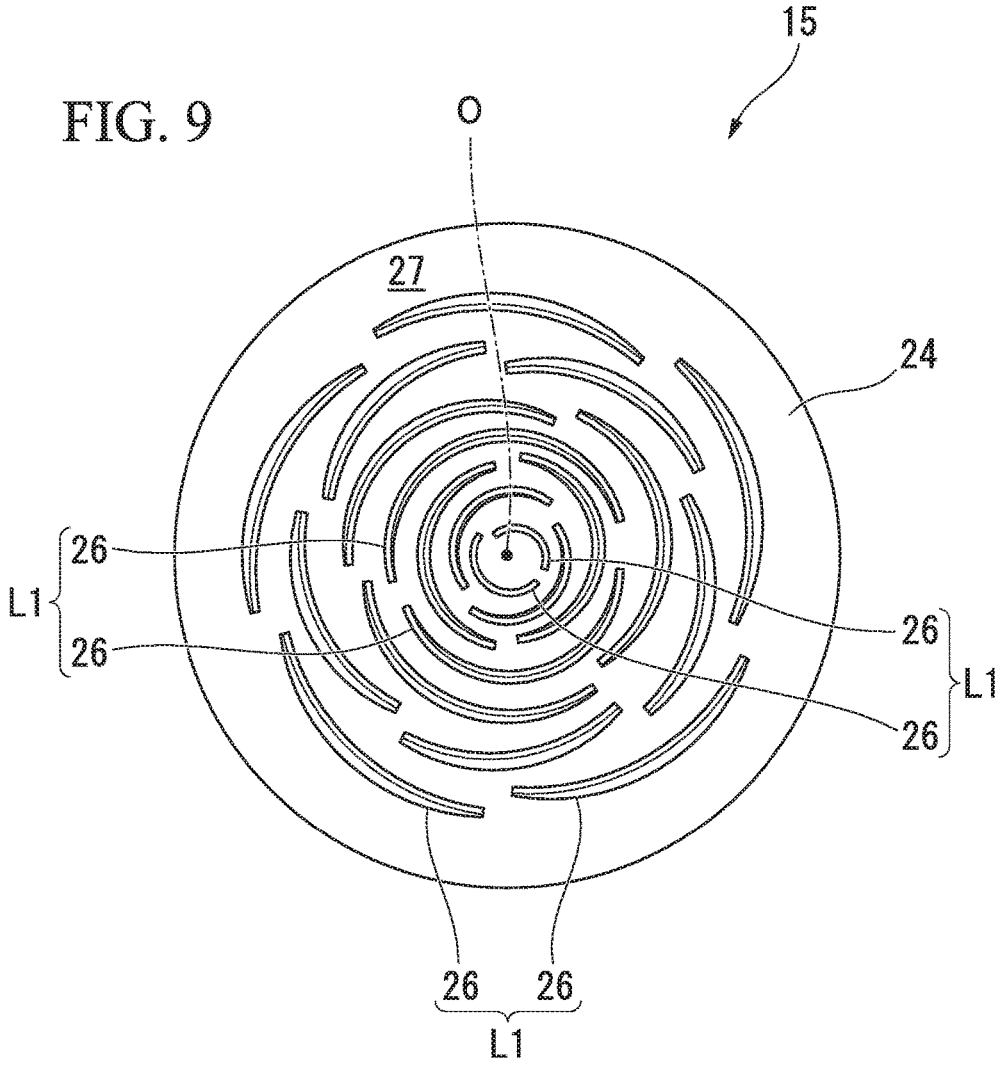
FIG. 9 is a plan view of an exterior portion of the discharge container shown in FIG. 8.
Figure 10:
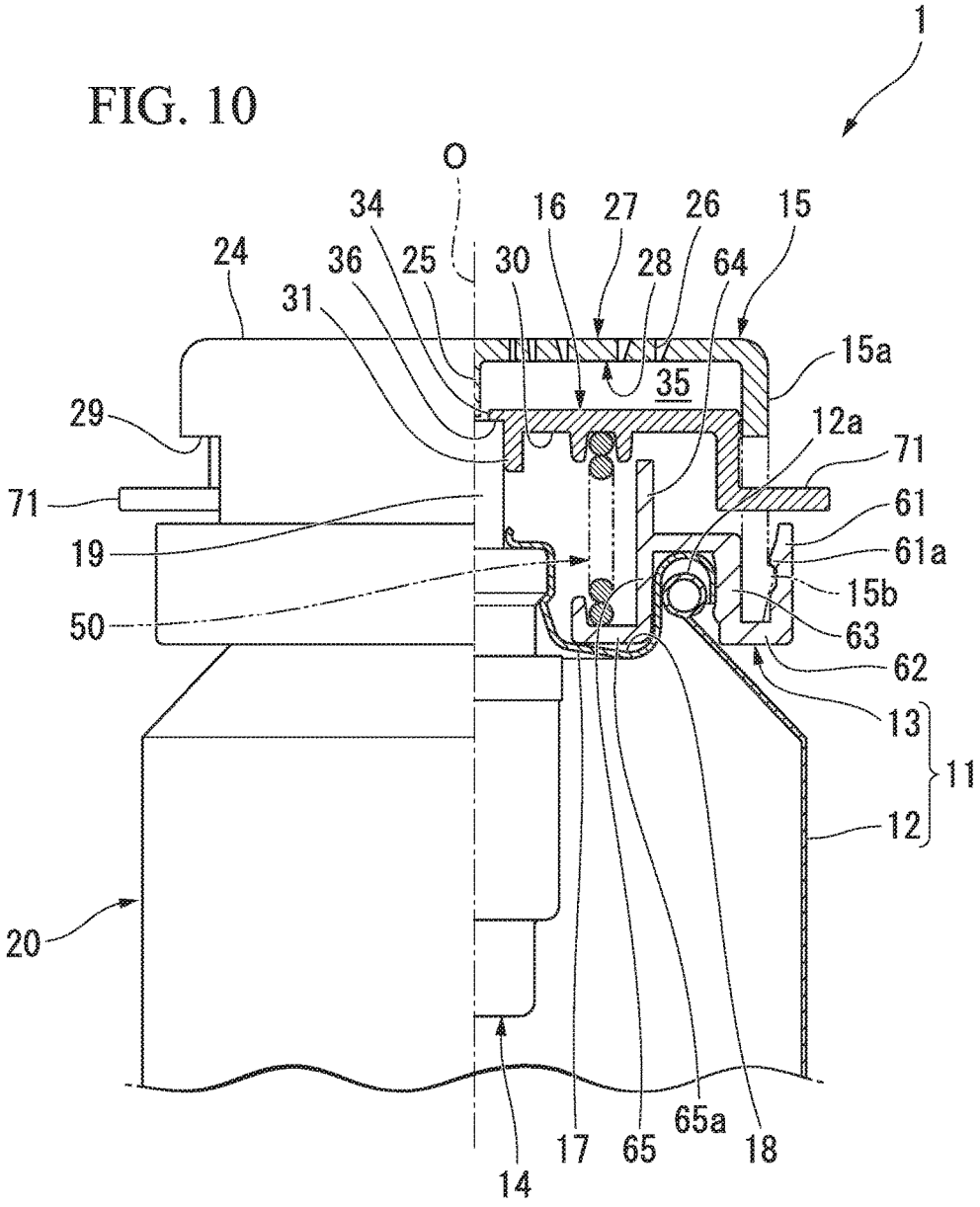
FIG. 10 is a longitudinal half sectional view of the discharge container shown in FIG. 9, and is a view showing a state in which the inner plate is located at the discharge position.
Figure 11:
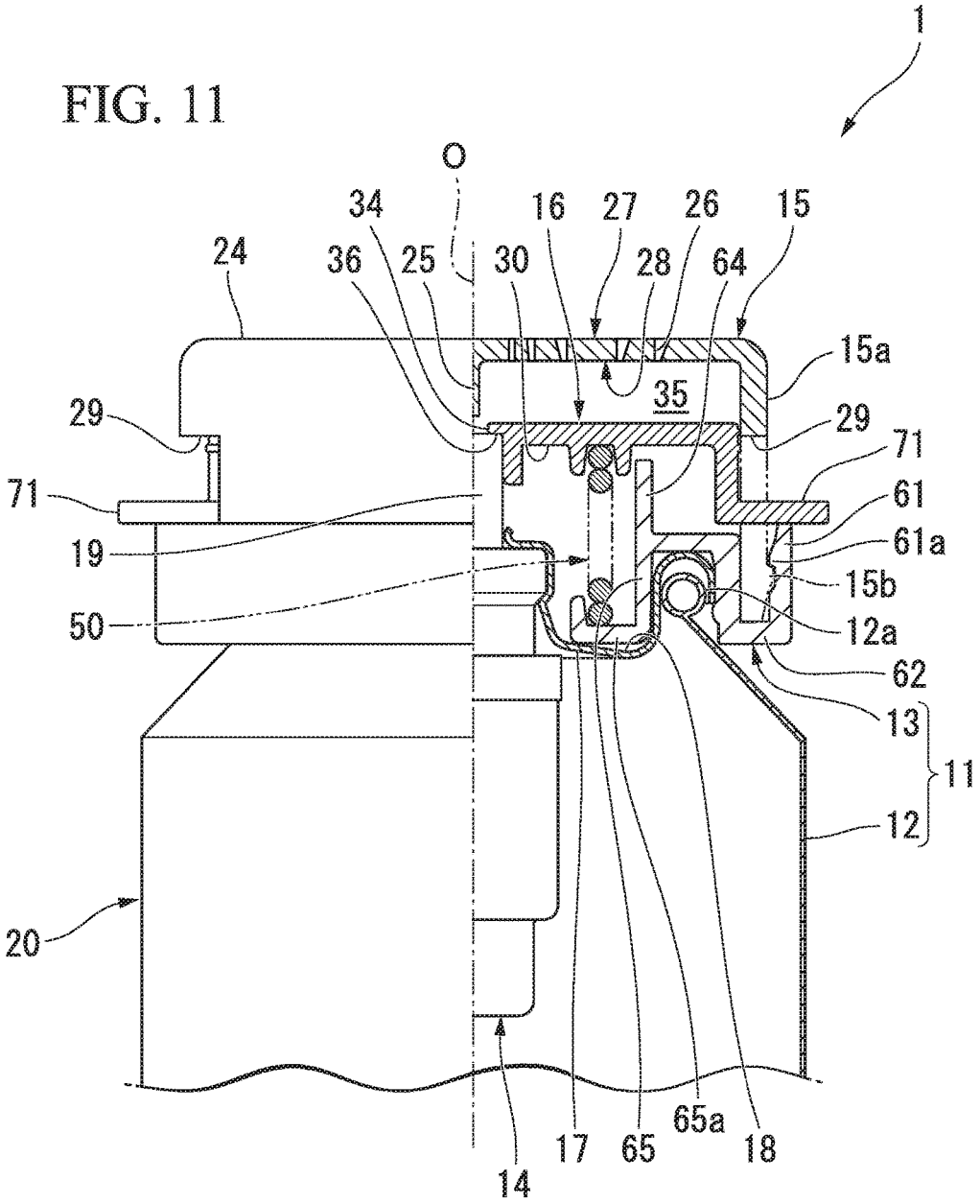
FIG. 11 is a longitudinal half sectional view of the discharge container shown in FIG. 10, and is a view showing a state in which the inner plate is located at a descent end.
Figure 12:
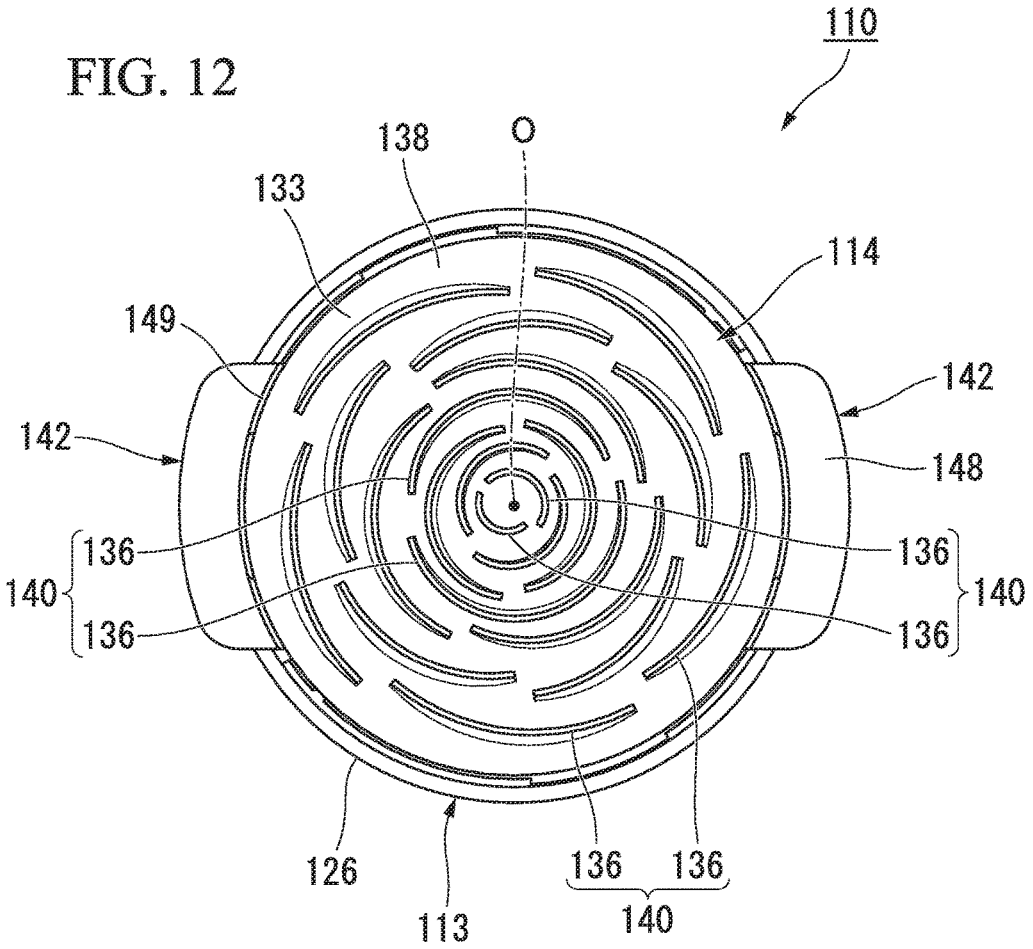
FIG. 12 is a plan view of a discharge container according to a third embodiment of the present invention.

FIG. 8 is a longitudinal half sectional view of a main part of a modified example of the discharge container according to the first embodiment of the present invention and is a view showing a state in which the inner plate is located at the standby position. FIG. 9 is a plan view of an exterior portion constituting the discharge container shown in FIG. 8. FIG. 10 is a longitudinal half sectional view of the discharge container shown in FIG. 9 and is a view showing a state in which the inner plate is located at the discharge position. FIG. 11 is a longitudinal half sectional view of the discharge container shown in FIG. 10 and is a view showing a state in which the inner plate is located at a descent end.

In FIGS. 8 to 11, the fixing member 13 is fixed to the mouth portion 12*a* of the container body 12 not to be rotatable around the container axis O and not to be movable upward. The outer fitting cylinder 63 is formed in a double cylindrical shape and is fitted to the mouth portion 12*a* of the container body 12 from outside in the radial direction. In the shown example, the outer fitting cylinder 63 is caulked from the outside in the radial direction to the mouth portion 12*a*, and thus rotation movement of the fixing member 13 around the container axis O and upward movement of the fixing member 13 are restricted. The exterior portion 15 may not have the lower engaging portion 15*b*, and the fixation member 13 may not have the upper engaging portion 61*a*.

Also, within the scope not deviating from the spirit of the present invention, it is possible to replace the elements in the first and second embodiments by well-known elements as appropriate, and the above-mentioned modified examples may be combined as appropriate.

Third Embodiment

Hereinafter, a discharge container for discharging contents to a discharge surface according to an embodiment of the present invention will be described with reference to FIGS. 12 to 23. As shown in FIGS. 12 to 19, a discharge container 110 includes a container main body 111, a discharger 112, a fixing member 113, and an exterior portion 114. The discharge container 110 discharges the contents that can hold its shape for at least a certain time after discharge such as a foamed material or a highly viscous material. The contents are accommodated in the container main body 111.

Here, in the embodiment, the container main body 111 is formed in a cylindrical shape with a bottom, and the exterior portion 114 is formed in a cylindrical shape with a top, and central axes thereof are disposed on a common axis. Hereinafter, the common axis is referred to as a container axis O, a side of the bottom of the container main body 111 in a direction of the container axis O is referred to as a lower side, and a side of a mouth portion 115 of the container main body 111 is referred to as an upper side. In a plan view of the discharge container 110 when seen in a direction of the container axis O, a direction orthogonal to the container axis O is referred to as a radial direction, and a surrounding direction around the container axis O is referred to as a circumferential direction.

Figure 13:
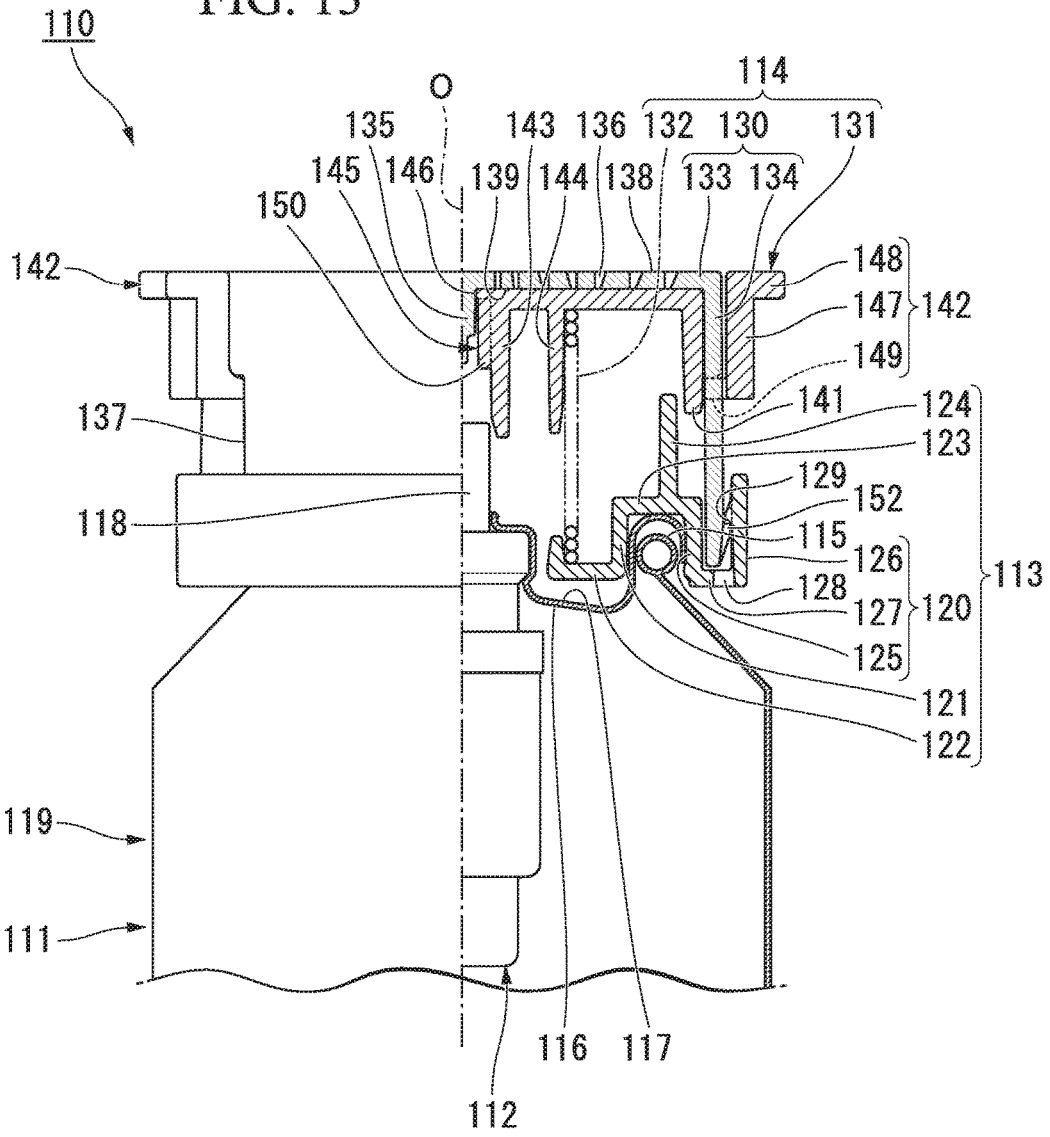
FIG. 13 is a half sectional view showing a state in which the inner plate is located at the standby position in the discharge container shown in FIG. 12.

As shown in FIG. 13, the container main body 111 is hermetically sealed by covering the mouth portion 115 of the container main body 111 with a top wall 116. An annular concave portion 117 extending in the circumferential direction is provided in the top wall 116. The annular concave portion 117 is recessed downward.

The discharger 112 includes a stem 118 provided upright upward on the mouth portion 115 of the container main body 111 to be movable downward in a state where the stem 118 is pushed upward. The stem 118 is disposed coaxially with the container axis O and is formed to have a diameter that is smaller than that of the annular concave portion 117. The stem 118 passes through the top wall 17. In the stem 118, a discharge valve that is not shown is provided in a portion thereof located inside the container main body 111.

When the stem 118 is pushed down with respect to the container main body 111, the discharge valve opens, and the contents in the container main body 111 pass through the stem 118 and are discharged from an upper end portion of the stem 118. At this time, in the embodiment, for example, the foamy contents in the container main body 111 are discharged from the upper end portion of the stem 118. When the pushing down of the stem 118 is released, the stem 118 is moved upward by an upward pushing force acting on the stem 118 and the discharge valve is closed, and the discharge of the contents is stopped. The container main body 111 and the discharger 112 described above constitute a discharge container main body 119 which discharges the contents stored in the container main body 111 from the stem 118. In the shown example, an aerosol can in which liquid contents are accommodated is adopted as the discharge container main body 119.

Figure 14:
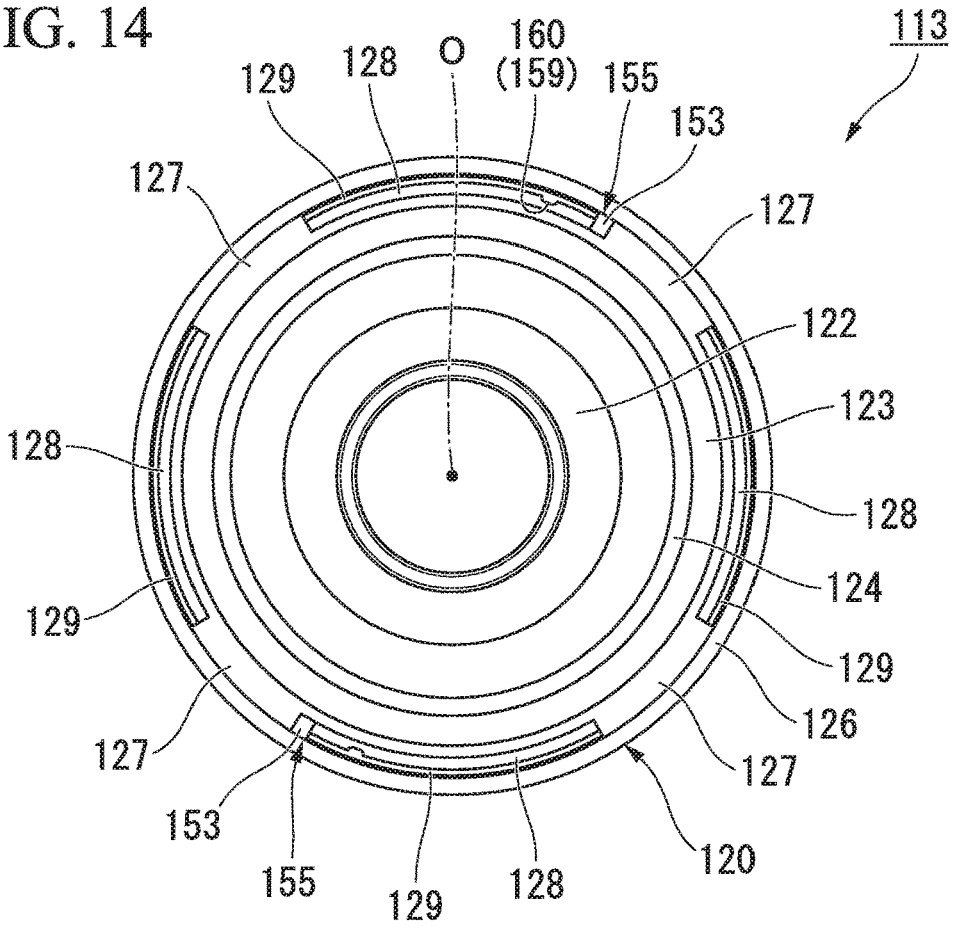
FIG. 14 is a plan view of a fixing member constituting the discharge container shown in FIG. 12.
Figure 15:
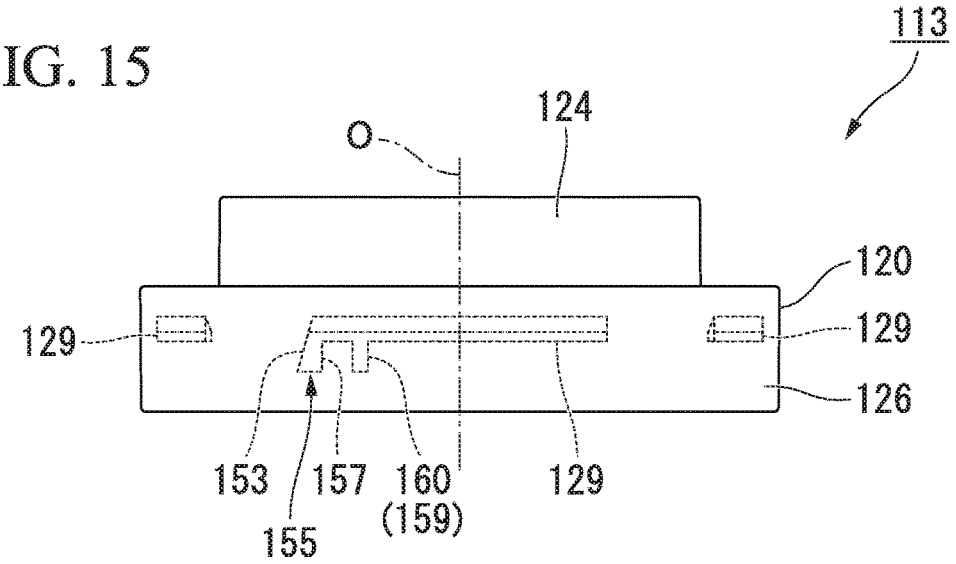
FIG. 15 is a side view of the fixing member shown in FIG. 14.

As shown in FIGS. 13 to 14, the fixing member 113 is attached to the mouth portion 115 of the container main body 111. The fixing member 113 is fixed to the mouth portion 115 of the container main body 111 to surround the stem 118 from the outside in the radial direction. The fixing member 113 is formed in a multiple cylindrical shape which is coaxial with the container axis O. The fixing member 113 is fixed to the mouth portion 115 of the container main body 111 not to be rotatable around the container axis O and not to be movable upward. The fixing member 113 includes an outer cylindrical portion 120, an inner cylindrical portion 121, a flange portion 122, a coupling portion 123, and an interior cylindrical portion 124.

The outer cylindrical portion 120 is formed in a double cylindrical shape having an annular groove which is open toward the upper side. The outer cylindrical portion 120 includes an outer fitting cylinder 125, a surrounding cylinder 126, and a connecting portion 127. The surrounding cylinder 126 surrounds the outer fitting cylinder 125 from the outside in the radial direction. The connecting portion 127 connects the outer fitting cylinder 125 with the surrounding cylinder 126. In the embodiment, a plurality of (four in the shown example) connecting portions 127 are disposed at intervals in the circumferential direction. A space between adjacent connecting portions 127 in the circumferential direction is an intermediate opening 128. In the embodiment, a plurality of (four in the shown example) intermediate openings 128 are disposed at intervals in the circumferential direction.

An upper engaging portion 129 is formed on an inner circumferential surface of the surrounding cylinder 126. The upper engaging portion 129 protrudes toward the inside in the radial direction from an inner circumferential surface of the surrounding cylinder 126. The upper engaging portion 129 linearly extends in the circumferential direction in a front view seen from the inside in the radial direction. In the embodiment, a plurality of (four in the shown example) upper engaging portions 129 are provided at intervals in the circumferential direction. The plurality of upper engaging portions 129 are provided corresponding to the plurality of intermediate openings 128. The upper engaging portions 129 are disposed at the same positions as the intermediate opening 128 in the circumferential direction.

The inner cylindrical portion 121 is fitted into the annular concave portion 117. The inner cylindrical portion 121 is fitted onto an outer circumferential surface of the annular concave portion 117 from the inside in the radial direction. The outer circumferential surface of the annular concave portion 117 faces the inside in the radial direction. The flange portion 122 is formed into an annular shape protruding toward the inside in the radial direction from the inner cylindrical portion 121. The coupling portion 123 is disposed above the mouth portion 115 of the container main body 111. The coupling portion 123 connects upper end portions of the outer fitting cylinder 125 and the inner cylindrical portion 121 to each other. The interior cylindrical portion 124 is disposed coaxially with the container axis O. The interior cylindrical portion 124 protrudes upward from the coupling portion 123.

The exterior portion 114 is attached to the fixing member 113 to be rotatable in the circumferential direction. The exterior portion 114 includes an exterior portion main body 130, an inner plate 131, and a pushing member 132. As shown in FIGS. 12, 13, 16 and 17, the exterior portion main body 130 is formed in a cylindrical shape with a top which is coaxial with the container axis O. The exterior portion main body 130 includes a top wall portion 133 and a circumferential wall portion 134. The top wall portion 133 is disposed above the stem 118. The top wall portion 133 is formed in a plate shape orthogonal to the container axis O. The circumferential wall portion 134 extends downward from the top wall portion 133. The circumferential wall portion 134 is inserted into a space (the annular concave portion 117) between the outer fitting cylinder 125 and the surrounding cylinder 126. A lower end portion of the circumferential wall portion 134 surrounds an upper end portion of the interior cylindrical portion 124 from the outside in the radial direction.

A core body 135, a molding hole 136 and an insertion hole 137 are formed in the exterior portion main body 130. The core body 135 extends downward from the top wall portion 133. The core body 135 extends in the direction of the container axis O and is disposed coaxially with the container axis O. The core body 135 is located above the upper end edge of the stem 118. An outer diameter of the core body 135 is smaller than an inner diameter of the stem 118, and the core body 135 faces the upper end portion of the stem 118 in the direction of the container axis O. The core body 135 is formed in a solid bar shape or column shape. The core body 135 is formed to have the same diameter over the entire length thereof in direction of the container axis O.

A plurality of molding holes 136 are formed in the exterior portion main body 130. The plurality of molding holes 136 pass through the top wall portion 133 in the direction of the container axis O. The plurality of molding holes 136 individually open in a discharge surface 138 facing an upper side of the top wall portion 133 and a supply surface 139 facing a lower side of the top wall portion 133. The discharge surface 138 and the supply surface 139 extend in a direction orthogonal to the container axis O.

The plurality of molding holes 136 are formed in a long hole shape which extends in the circumferential direction. The plurality of molding holes 136 are disposed at intervals in the circumferential direction and the radial direction. In the embodiment, a plurality of molding holes 136 disposed at intervals in the circumferential direction form a hole array 140. The hole arrays 140 are disposed at multiple positions centering on the container axis O. The hole arrays 140 are disposed to surround the core body 135 from the outside in the radial direction in a plan view.

The insertion hole 137 passes through the circumferential wall portion 134 in the radial direction. The insertion hole 137 extends downward from a center portion of the circumferential wall portion 134 in the direction of the container axis O and opens downward. In the embodiment, a plurality of insertion holes 137 are provided at intervals in the circumferential direction. In the shown example, four insertion holes 137 are provided. Two of the four insertion holes 137 are disposed at each of positions facing each other on the circumferential wall portion 134 with the container axis O interposed therebetween in the radial direction.

As shown in FIG. 13, the inner plate 131 is vertically movably provided in the exterior portion main body 130. The rotational movement of the inner plate 131 with respect to the exterior portion main body 130 is restricted. The inner plate 131 includes an inner plate main body 141, a pushing-down portion 142, a guide cylinder 143, a support cylinder 144, and a locking portion 145.

The inner plate main body 141 is fitted into the exterior portion main body 130. An outer circumferential edge of the inner plate main body 141 is slidable on the inner circumferential surface of the exterior portion main body 130 in the direction of the container axis O. A communication hole 146 is formed in the inner plate main body 141. The communication hole 146 passes through the inner plate main body 141 in the direction of the container axis O. The communication hole 146 is disposed coaxially with the container axis O. The communication hole 146 has a larger diameter than the core 135. The core body 135 is inserted into the communication hole 146. The communication hole 146 has a smaller diameter than an outer diameter of the stem 118.

Figure 16:
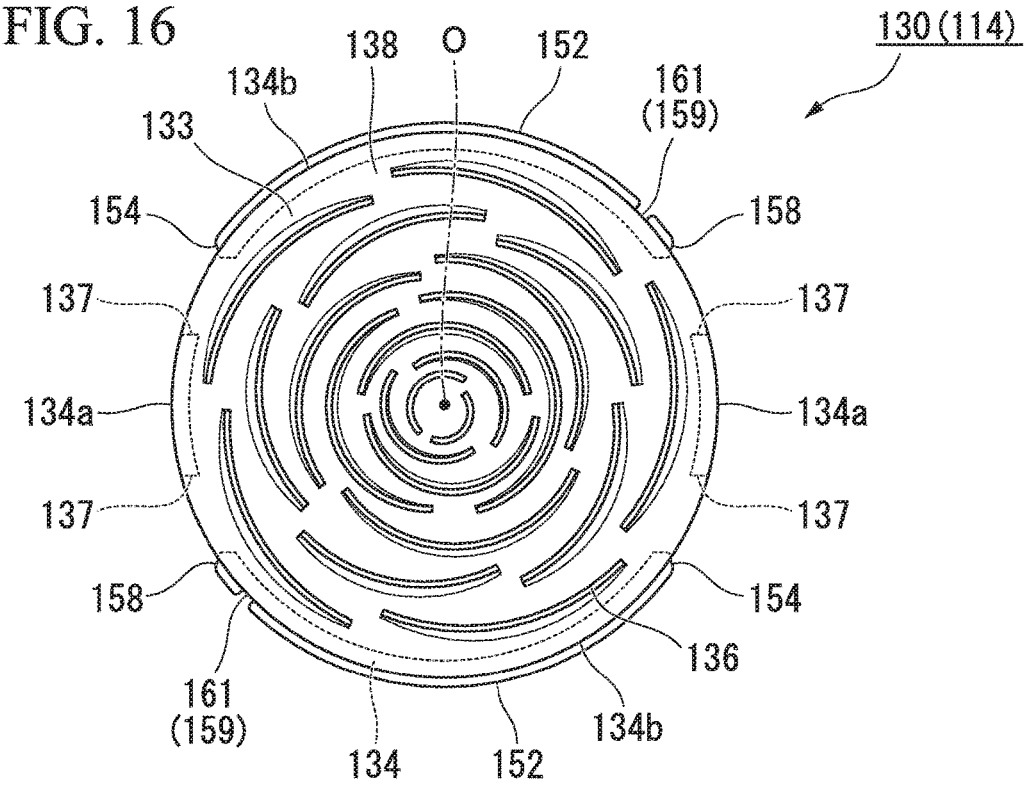
FIG. 16 is a plan view of an exterior portion main body constituting the discharge container shown in FIG. 12.
Figure 17:
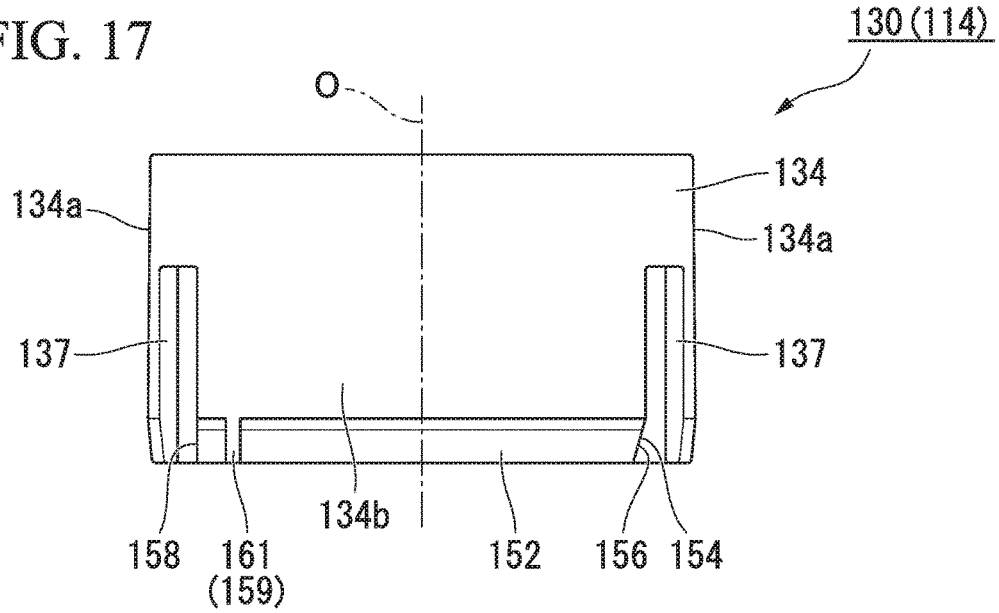
FIG. 17 is a side view of the exterior portion main body shown in FIG. 16.

The pushing-down portion 142 protrudes toward the outside in the radial direction from the inner plate main body 141 and is disposed on the outside of the exterior portion main body 130 through the insertion hole 137. In the shown example, two pushing-down portions 142 are provided individually at each of positions facing each other with the container axis O interposed therebetween in the radial direction. The two pushing-down portions 142 are disposed one by one at each of positions, at which the two insertion holes 137 are disposed, among the respective positions on the circumferential wall portion 134 in the circumferential direction. As shown in FIGS. 16 and 17, a portion (hereinafter, referred to as a "disposed portion 134*a*") in which the pushing-down portion 142 is disposed and a portion (hereinafter, referred to as an "avoided portion 134*b*") which avoids the disposed portion 134*a* are provided on an outer circumferential surface of the circumferential wall portion 134. The disposed portion 134*a* and the avoided portion 134*b* are alternately disposed in the circumferential direction. The disposed portion 134*a* is smaller than the avoided portion 134*b* in the circumferential direction.

As shown in FIG. 13, each of the pushing-down portions 142 includes a side plate 147, a pushing-down plate 148 and a coupling plate 149. A front surface and a back surface of the side plate 147 extend along the outer circumferential surface of the exterior portion main body 130. The pushing-down plate 148 protrudes toward the outside in the radial direction from the side plate 147. The pushing-down plate 148 is disposed at an upper end portion of the side plate 147. The front surface and the back surface of the pushing-down plate 148 are directed in the direction of the container axis O. The coupling plate 149 connects the side plate 147 with the inner plate main body 141. The coupling plate 149 is inserted into the insertion hole 137. In the embodiment, a plurality of coupling plates 149 are provided at intervals in the circumferential direction on each of a plurality of pushing-down portions 142. In the shown example, four coupling plates 149 are provided so that two coupling plates 149 are provided for each of the two pushing-down portions 142. Two (plural) coupling plates 149 provided in each of the two pressing portions 142 are separately inserted into two (plural) insertion holes 137. Each of the coupling plates 149 is in contact with or close to an upper edge of an opening circumferential edge of the insertion hole 137 in the circumferential wall portion 134 which is located at the upper end and directed downward.

The guide cylinder 143 and the support cylinder 144 extend downward from the inner plate main body 141. The guide cylinder 143 and the support cylinder 144 are disposed coaxially with the container axis O. The guide cylinder 143 has a larger diameter than the communication hole 146. The support cylinder 144 has a larger diameter than the guide cylinder 143. The guide cylinder 143 is externally inserted onto the stem 118 to be relatively rotatable around the container axis O and to be advanceable and retractable in the direction of the container axis O.

The locking portion 145 is locked to the stem 118 and moves down the stem 118. The locking portion 145 is disposed in the guide cylinder 143. The locking portion 145 is formed by a plurality of vertical ribs 150 provided on an inner circumferential surface of the guide cylinder 143. The vertical ribs 150 protrude toward the inside in the radial direction from the guide cylinder 143. The plurality of vertical ribs 150 are provided at intervals in the circumferential direction. The locking portion 145 faces an upper end edge of the stem 118 from the upper side. The locking portion 145 moves down the stem 118 as the inner plate 131 moves down. In the embodiment, when the inner plate 131 moves down, lower end edges of the vertical ribs 150 are in contact with and push down the upper end edge of the stem 118, and thus the stem 118 is moved down.

Figure 19:
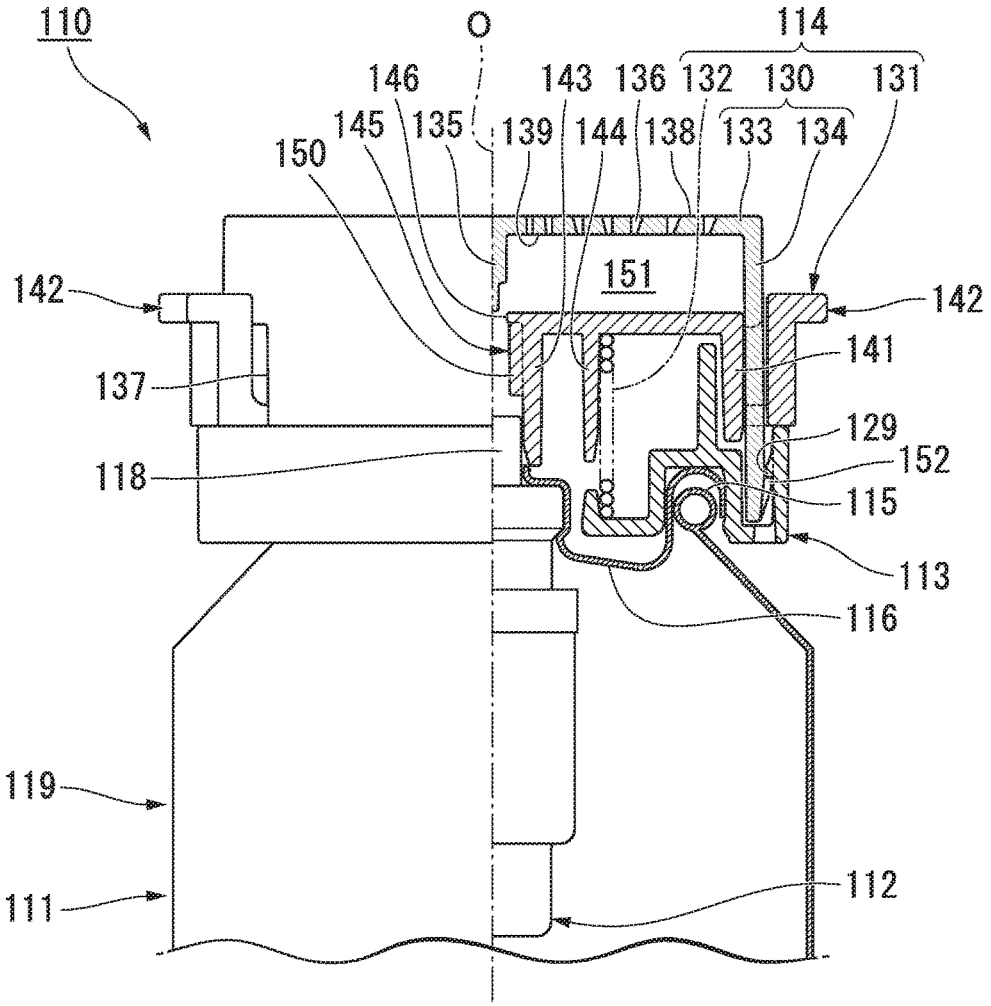
FIG. 19 is a half sectional view showing a state in which the inner plate is located at the discharge position in the discharge container shown in FIG. 12.

The inner plate 131 moves in the vertical direction between an upper standby position in which the supply surface 139 is in contact therewith or close thereto as shown in FIG. 13 and a lower discharge position in which the stem 118 is moved down to supply the contents from the stem 118 into a diffusion chamber 151 as shown in FIG. 19. As shown in FIG. 13, when the inner plate 131 is located at the standby position, the core body 135 is inserted into the communication hole 146.

As shown in FIG. 19, in the discharge position, the inner plate 131 moves downward from the supply surface 139 and forms the diffusion chamber 151 between the supply surface 139 and the inner plate 131. The diffusion chamber 151 is disposed on the inside of the circumferential wall portion 134. A wall surface of the diffusion chamber 151 is formed by the supply surface 139, the inner circumferential surface of the circumferential wall portion 134 and an upper surface of the inner plate main body 141. The diffusion chamber 151 diffuses the contents from the stem 118 in the radial direction (a direction along the discharge surface 138 and the supply surface 139) so that the contents are supplied into each of the plurality of molding holes 136. The diffusion chamber 151 is disposed coaxially with the container axis O. The diffusion chamber 151 is formed in a flat shape that is larger in the radial direction than in the direction of the container axis O. The diffusion chamber 151 communicates with the inside of the stem 118 through the communication hole 146.

The pushing member 132 is disposed between the fixing member 113 and the inner plate 131. The pushing member 132 is formed of a spring member (coil spring). The pushing member 132 pushes the inner plate 131 located at the discharge position upward to the standby position. An upper end portion of the pushing member 132 is externally inserted onto the support cylinder 144 and is in contact with a lower surface of the inner plate main body 141. A lower end portion of the pushing member 132 is in contact with an upper surface of the flange portion 122.

As shown in FIGS. 13, 14, 16 and 17, a lower engaging portion 152 is formed on the outer circumferential surface of the circumferential wall portion 134. The lower engaging portion 152 is engaged with the upper engaging portion 129 from the lower side of the upper engaging portion 129. The lower engaging portion 152 protrudes toward the outside in the radial direction from the outer circumferential surface of the circumferential wall portion 134. The lower engaging portion 152 linearly extends in the circumferential direction in a plan view seen from the outside in the radial direction. In the embodiment, a plurality of (two in the shown example) lower engaging portions 152 are provided at intervals in the circumferential direction. The lower engaging portion 152 is disposed in the avoided portion 134*b*. One pair of lower engaging portions 152 are provided corresponding to the two avoided portions 134*b*. The lower engaging portion 152 extends over the entire circumferential length of the avoided portion 134*b*. A circumferential end portion of the lower engaging portion 152 is located at the opening circumferential edge of the insertion hole 137 in the circumferential wall portion 134.

Figure 18:
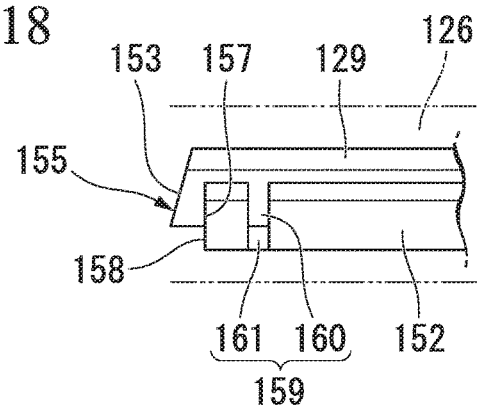
FIG. 18 is a schematic view showing an upper engaging portion and a lower engaging portion constituting the discharge container shown in FIG. 12, and is a front view showing a state in which both engaging portions are combined when seen through a surrounding cylinder from the outside in a radial direction.

As shown in FIGS. 14 and 18, guide surfaces 153 are formed on the fixing member 113, and guide surfaces 154 are formed on the circumferential wall portion 134. The guide surfaces 153 and 154 collide with and come into sliding contact with each other in the circumferential direction as a result of the relative rotational movement of the exterior portion 114 and the fixing portion 113, and thus move up the exterior portion 114 with respect to the fixing member 113. When the exterior portion 114 rotates to one side with respect to the fixing member 113 in the circumferential direction, the guide surfaces 153 and 154 collide with each other.

In the embodiment, a pair of guide surfaces 153 are provided on the fixing member 113 to be located on opposite sides in the radial direction (positions facing each other) with the container axis O interposed therebetween, and a pair of guide surfaces 154 are provided on the circumferential wall portion 134 to be located on opposite sides in the radial direction (positions facing each other) with the container axis O interposed therebetween. The pair of guide surfaces 153 are formed integrally with the upper engaging portion 129, and the pair of guide surfaces 154 are formed integrally with the lower engaging portion 152. A guide protrusion 155 having a first guide surface 153 of the guide surfaces 153 and 154 is provided on a circumferential end portion of the upper engaging portion 129, and a circumferential end surface of the lower engaging portion 152 is a second guide surface 154 of the guide surfaces 153 and 154.

The guide protrusion 155 is provided on the upper engaging portion 129. In the embodiment, a pair of guide protrusions 155 are provided to be located on the opposite sides in the radial direction (positions facing each other) with the container axis O interposed therebetween. The pair of guide protrusions 155 are provided on two upper engaging portions 129 of the four upper engaging portions 129. The pair of guide protrusions 155 are provided at the circumferential end portion on the other side of each of the two upper engaging portions 129 in the circumferential direction.

The guide protrusion 155 protrudes from the upper engaging portion 129 in the direction of the container axis O. The guide protrusion 155 protrudes downward from the upper engaging portion 129. The guide protrusion 155 is formed integrally with the surrounding cylinder 126. The guide protrusion 155 is connected to the inner circumferential surface of the surrounding cylinder 126 over the entire length of the guide protrusion 155.

The first guide surface 153 is formed by a circumferential end surface of the guide protrusion 155 that faces the other side in the circumferential direction. The first guide surface 153 is an inclined surface that gradually extends toward one side in the circumferential direction as it goes from the lower side to the upper side. An end face of the upper engaging portion 129 that faces the other side in the circumferential direction is an inclined surface that is smoothly connected to the first guide surface 153 without a step.

The second guide surface 154 is formed by a circumferential end surface of the lower engaging portion 152 that faces one side in the circumferential direction. The second guide surface 154 is an inclined surface that gradually extends toward one side in the circumferential direction as it goes from the lower side to the upper side. In the shown example, a chamfered portion 156 corresponding to the second guide surface 154 is formed on the opening circumferential edge of the insertion hole 137 in the circumferential wall portion 134. The chamfered portion 156 is disposed in a portion of the opening circumferential edge in which the second guide surface 154 (the circumferential end surface of the lower engaging portion 152) is located. The chamfered portion 156 is formed along the second guide surface 154.

Restricting surfaces 157 and 158 are separately formed in the fixing member 113 and the circumferential wall portion 134. The restricting surfaces 157 and 158 collide with each other in the circumferential direction as a result of the relative rotational movement of the exterior portion 114 and the fixing portion 113, and are locked to each other and thus restrict further rotational movement. When the exterior portion 114 rotates toward the other side with respect to the fixing member 113 in the circumferential direction, the restricting surfaces 157 and 158 collide with each other.

The restricting surfaces 157 and 158 are formed integrally with the upper engaging portion 129 and the lower engaging portion 152, respectively. The restricting surfaces 157 and 158 include a first restricting surface 157 and a second restricting surface 158. The first restricting surface 157 is provided in the upper engaging portion 129, and the first restricting surface 157 is provided in the lower engaging portion 152.

The first restricting surface 157 is provided at a circumferential end of the upper engaging portion 129 on one side in the circumferential direction. The first restricting surface 157 is formed by a circumferential end surface of the guide protrusion 155 that faces the one side in the circumferential direction. The first restricting surface 157 is a straight surface extending in the direction of the container axis O. The second restricting surface 158 is formed by a circumferential end surface of the lower engaging portion 152 that faces the other side in the circumferential direction. The second restricting surface 158 is a straight surface extending in the direction of the container axis O.

An anti-rotation portion 159 is provided at the fixing member 113 and the circumferential wall portion 134. The anti-rotation portion 159 restricts relative rotation of the exterior portion 114 and the fixing member 113. The anti-rotation portion 159 includes a first anti-rotation portion 160 and a second anti-rotation portion 161. The first anti-rotation portion 160 is provided on the fixing member 113, and the second anti-rotation portion 161 is provided on the circumferential wall portion 134. The first anti-rotation portion 160 is formed integrally with the upper engaging portion 129 of the fixing member 113, and the second anti-rotation portion 161 is formed integrally with the lower engaging portion 152 of the exterior portion 114.

The first anti-rotation portion 160 is formed by a protrusion protruding from the inner circumferential surface of the circumferential wall portion 134. The first anti-rotation portion 160 linearly extends downward from the upper engaging portion 129. The first anti-rotation portion 160 has the same length as that of the guide protrusion 155. The second anti-rotation portion 161 is formed by a longitudinal groove disposed in the lower engaging portion 152. The second anti-rotation portion 161 longitudinally cuts the lower engaging portion 152 over the entire length in the direction of the container axis O.

When the first anti-rotation portion 160 is fitted into the second anti-rotation portion 161, the anti-rotation portion 159 restricts the relative rotation based on an inadvertent external force in the circumferential direction of the exterior portion 114 and the fixing member 113. At this time, the restricting surfaces 157 and 158 are in contact with or close to each other. Further, center portion of the intermediate opening 128 in the circumferential direction and center portion of the pushing-down portion 142 in the circumferential direction are disposed at the same position in the circumferential direction. The first anti-rotation portion 160 is detachably fitted into the second anti-rotation portion 161 in the circumferential direction. When a user intentionally applies a rotational force to the exterior portion 114 and the fixing member 113, the first anti-rotation portion 160 is detached from the second anti-rotation portion 161 in the circumferential direction, and the above-described restriction is released.

Next, an operation of the discharge container 110 according to the present embodiment will be described.

In an initial state before use of the discharge container 110, the inner plate 131 is disposed at the standby position as shown in FIG. 1. When the contents are discharged, as shown in FIG. 19, the pushing-down portion 142 is pushed down, and the inner plate 131 is moved down toward the discharge position. Therefore, an inner volume of the diffusion chamber 151 located between the top wall portion 133 of the exterior portion main body 130 and the inner plate 131 increases, and the locking portion 145 is locked to the upper end portion of the stem 118. As the inner plate 131 is moved further down, the stem 118 locked to the locking portion 145 is moved down against the upward pushing force, and thus the contents in the container main body 111 flow into the diffusion chamber 151 through the stem 118.

The contents discharged from the stem 118 are supplied into the diffusion chamber 151 through the communication hole 146. The contents are discharged upward from the communication hole 146, supplied to the core body 135, flow on the outer circumferential surface of the core body 135 in the direction of the container axis O, and are held by the core body 135. At this time, for example, the contents are held by the core body 135 to form a circle centering on the core body 135 in a plan view. When the supply amount of the contents to the core body 135 increases as a discharge amount of the contents from the stem 118 increases, the contents enlarge on the core body 135 and gradually expand toward the outside in the radial direction. Accordingly, in conjunction with the fact that the diffusion chamber 151 is formed to be flattened as described above, the contents supplied to the diffusion chamber 151 diffuse in the radial direction and are supplied from the supply surface 139 to the plurality of molding holes 136. When the contents are molded by passing through each of the plurality of the molding holes 136, a plurality of shaped pieces are formed. A modeled object is formed by combining these shaped pieces on the discharge surface 138. The shaped piece molded by the molding hole 136 is formed to be long in the direction in which the molding hole 136 extends.

Thereafter, when the pushing-down operation of the pushing-down portion 142 is released, the inner plate 131 receives an upward pushing force from each of the stem 118 and the pushing member 32. Therefore, as the stem 118 moves up, the inner plate 131 moves upward with respect to the exterior portion main body 130 and is restored and displaced to the standby position. Then, as shown in FIG. 13, when the inner plate 131 comes into contact with or becomes close to the supply surface 139, the volume of the diffusion chamber 151 decreases, and the diffusion chamber 151 substantially or completely disappears. Therefore, even if contents remain in the diffusion chamber 151 before the inner plate 131 is moved upward, these contents are pushed out from the diffusion chamber 151 to the exterior and discharged to the discharge surface 138 through the molding hole 136.

When the exterior portion 114 is detached from the fixing member 113, the exterior portion 114 and the fixing portion 113 are relatively rotated in the circumferential direction. At this time, for example, when a rotational force directed to one side in the circumferential direction is applied to the exterior portion 114, the first anti-rotation portion 160 is detached from the second anti-rotation portion 161, and the rotation restriction by the anti-rotation portion 159 is released. When the exterior portion 114 rotates toward one side in the circumferential direction, the first restricting surface 157 and the second restricting surface 158 become spaced apart in the circumferential direction, and the first guide surface 153 and the second guide surface 154 come close to each other in the circumferential direction.

Figure 20:
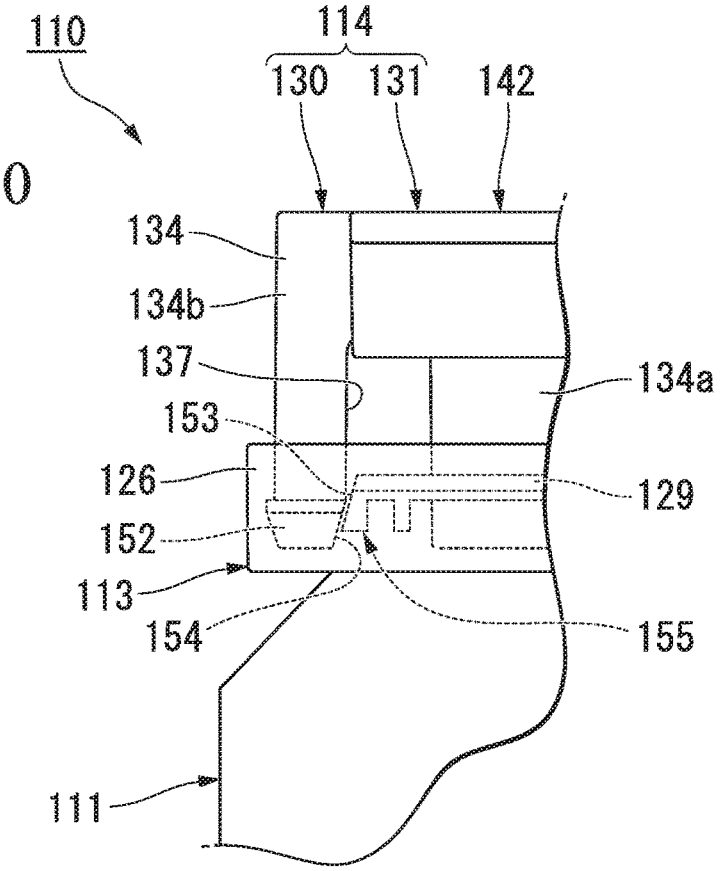
FIG. 20 is a partial side view showing a state in which the exterior portion and the fixing member are relatively rotated and moved and guide surfaces are collide with each other in the discharge container shown in FIG. 12.
Figure 21:
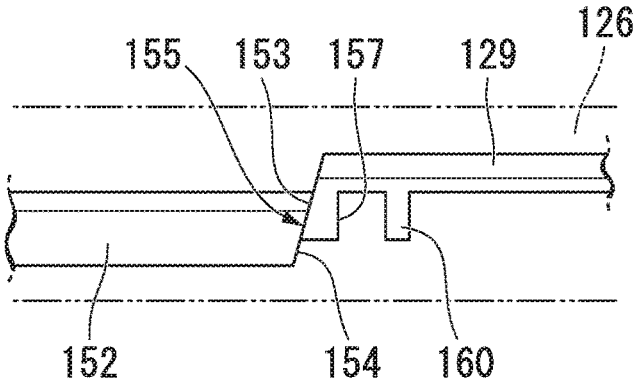
FIG. 21 is a schematic view showing an upper engaging portion and a lower engaging portion constituting the discharge container shown in FIG. 12, and is a front view showing a state in which the guide surfaces collide with each other when the state shown in FIG. 20 is seen through a surrounding cylinder from the outside in a radial direction.
Figure 22:
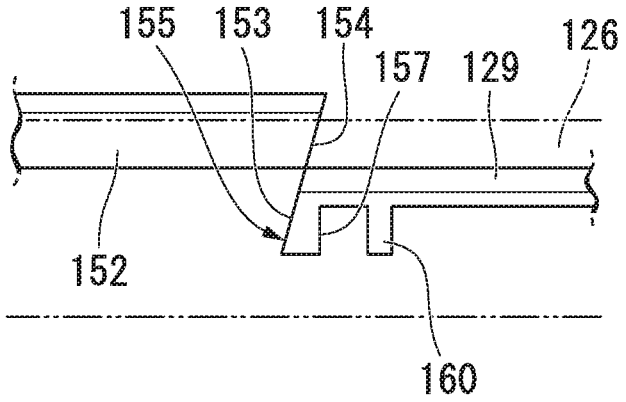
FIG. 22 is a front view showing a state in which the exterior portion and the fixing member are relatively rotated and moved from the state shown in FIG. 21, and the exterior portion is moved up with respect to the fixing member.
Figure 23:
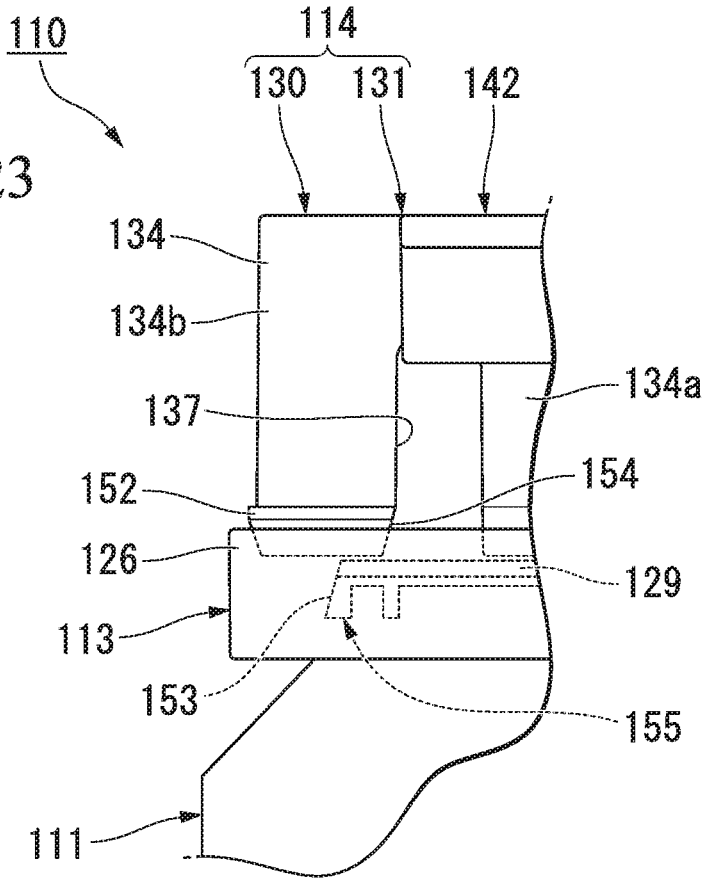
FIG. 23 is a partial side view showing a state in which the exterior portion and the fixing member are further relatively rotated and moved from the state shown in FIG. 22 in the discharge container shown in FIG. 12.

As shown in FIGS. 20 and 21, the exterior portion 114 and the fixing member 113 are rotated relatively in the circumferential direction until the guide surfaces 153 and 154 of the fixing member 113 and the circumferential wall portion 134 collide with each other. Then, as the guide surfaces 153 and 154 come into sliding contact with each other, the exterior portion 114 moves upward with respect to the fixing member 113 as shown in FIGS. 22 and 23. At this time, the lower engaging portion 152 climbs over the upper engaging portion 129, and the engagement between the upper engaging portion 129 and the lower engaging portion 152 is released.

After the exterior portion 114 is detached from the fixing member 113, the exterior portion 114 can be cleaned. Therefore, it is possible to hold the molding hole 136 cleanly, to discharge the contents with high precision and smoothly through the molding hole 136, and so on. In addition, when the contents in the container main body 111 are exhausted, after the exterior portion 114 is detached from the fixing member 113, the exterior portion 114 may be reused by assembling the exterior portion 114 on another container main body 111 (the fixing member 113).

As described above, according to the discharge container 110 of the embodiment, when the contents are discharged, the contents in the container main body 111 diffuse in the radial direction in the diffusion chamber 151 and are then supplied to the molding hole 136. Therefore, it is possible to prevent the contents from being concentrated in a molding hole 136 disposed in a specific part on the discharge surface 138 and to supply the contents to the molding holes 136 with less variation. Accordingly, it is possible to minimize variation in the discharge amount of the contents discharged onto the discharge surface 138 at each position.

The engagement between the upper engaging portion 129 and the lower engaging portion 152 can be released by relatively rotating the exterior portion 114 and the fixing member 113 in the circumferential direction. Therefore, the operability when separating the exterior portion 114 from the fixing member 113 can be enhanced. The exterior portion 114 can be easily cleaned or can be easily reused by improving this operability. Since the guide surfaces 153 are integrally formed with the upper engaging portion 129 and the guide surfaces 154 are integrally formed with the lower engaging portion 152, for example, it is possible to simplify a structure, and so on.

The guide protrusion 155 including the first guide surface 153 is provided at a circumferential end portion of one of the upper engaging portion 129 and the lower engaging portion 152, and the circumferential end portion of the other one of the upper engaging portion 129 and the lower engaging portion 152 is the second guide surface 154. Therefore, when the guide surfaces 153 of the fixing member 113 and the guide surfaces 154 of the circumferential wall portion 134 are brought into sliding contact with each other, the guide protrusion 155 can receive a force in the circumferential direction that the first guide surface 153 receives from the second guide surface 154. Also, a force in the circumferential direction that the second guide surface 154 receives from the first guide surface 153 can be received by the lower engaging portion 152. Accordingly, it is possible to stably move the exterior portion 114 upward with respect to the fixing member 113.

The pair of guide surfaces 153 are provided on the fixing member 113 such that they are located on opposite sides in the radial direction (positions facing each other) with the container axis O interposed therebetween, and the pair of guide surfaces 154 are provided on the circumferential wall portion 134 such that they are located on opposite sides in the radial direction (positions facing each other) with the container axis O interposed therebetween. Therefore, when the exterior portion 114 and the fixing member 113 are relatively rotated in the circumferential direction, the pair of guide surfaces 153 of the fixing member 113 and the pair of guide surfaces 154 of the circumferential wall portion 134 can be brought into mutual collision at each position on the opposite sides in the radial direction (positions facing each other) with the container axis O interposed therebetween. Therefore, it is possible to move upward the exterior portion 114 more stably with respect to the fixing member 113.

When the exterior portion 114 rotates toward the other side in the circumferential direction with respect to the fixing member 113, the restricting surfaces 157 and 158 collide with each other. Therefore, for example, even in the case in which the user rotates the exterior portion 114 and the fixing member 113 in a direction opposite to the direction in which the exterior portion 114 is separated from the fixing member 113 when the user separates the exterior portion 114 from the fixing member 113, rotation of the exterior portion 114 and the fixing member 113 is restricted. Therefore, it is possible to allow the user to easily recognize a fact that the exterior portion 114 and the fixing member 113 are being rotated in the wrong direction, and thus it is easy to improve the operability.

The technical scope of the present invention is not limited to the third embodiment, and various modifications can be made without departing from the spirit of the present invention.

For example, the restricting surfaces 157 and 158 may not be provided. In each of the fixing member 113 and the circumferential wall portion 134, only one guide surface 153 or 154 may be provided, or three or more guide surfaces 153 and 154 may be provided. The guide surfaces 153 and 154 may be formed independently at the upper engaging portion 129 and the lower engaging portion 152, respectively. The core body 135 may not be provided. The guide protrusion 155 may be provided in the lower engaging portion 152. In this case, as the guide protrusion 155, a structure protruding upward from the lower engaging portion 152 may be employed.

In the third embodiment, the inner plate 131 moves up and down, but the present invention is not limited thereto. For example, a constitution in which the inner plate 131 is fixed in the vertical direction and the volume of the diffusion chamber 151 is not changed may be employed.

As the molded objects, characters, logotypes, and so on can be formed. In the third embodiment, the molded object is formed on the discharge surface 138, but the present invention is not limited thereto. For example, the contents may be simply discharged without forming a molded object on the discharge surface 138. For example, it is possible to appropriately change the number and shape of the molding holes 136 (discharge holes) according to the shape of the molded object which is molded by the discharge container 110, the application of the contents to be discharged, and so on. For example, the number of molding holes 136 may be one.

In the third embodiment, an aerosol can is used as the discharge container main body 119, but the present invention is not limited thereto. For example, it is possible to employ a constitution including the discharger 112 including a pump mechanism as the discharge container main body 119.

Also, within the scope not deviating from the spirit of the present invention, it is possible to appropriately replace the elements in the third embodiment with well-known elements, and the above-described modified examples may be combined as appropriate.

Fourth Embodiment

Hereinafter, a constitution of a discharge container according to a fourth embodiment will be described with reference to FIGS. 24 to 28. As shown in FIGS. 24 to 28, a discharge container 201 includes a container body 202 having a container main body 210 in which contents are stored, a discharger 203, an exterior portion 214 (shaped portion), and an inner plate 215. The discharge container 201 discharges contents that can hold a shape for at least a certain time after discharge such as a foamed material or a highly viscous material. A cap 240 having a cylindrical shape with a top is attached to the discharge container 201.

Here, in the embodiment, the container main body 210 is formed in a cylindrical shape with a bottom, and the exterior portion 214 is formed in a cylindrical shape with a top, and central axes of the container main body 210 and the exterior portion 214 are disposed on a common axis. Hereinafter, this common axis is referred to as a container axis O, a side of the bottom of the container body 210 in the direction of the container axis O is referred to as a lower side, and a side of a mouth portion 210*a* of the container body 210 is referred to as an upper side. In a plan view of the discharge container 201 seen in the direction of the container axis O, a direction orthogonal to the container axis O is referred to as a radial direction, and a surrounding direction around the container axis O is referred to as a circumferential direction.

(Container Body)

The container body 202 includes a container main body 210 and a fixing member 213 attached to the mouth portion 210*a* of the container body 210. The inside of the container main body 210 is hermetically sealed by the mouth portion 210*a* being covered with a top wall plate 217. An annular concave portion 218 that extends in the circumferential direction and is recessed downward is provided in the top wall plate 217. The fixing member 213 is formed in a multiple cylinder shape that is coaxial with the container axis O and is fixed to the mouth portion 210*a* of the container body 210.

The discharger 203 has a stem 203*a* provided upright in the mouth portion 210*a* of the container body 210 to be movable downward in a state where the stem 203*a* is pushed upward and is supported by the top wall plate 217. The stem 203*a* is disposed coaxially with the container axis O and formed to have a smaller diameter than that of the annular concave portion 218. The stem 203*a* passes through the top wall plate 217. A discharge valve, which is not shown, is provided in a portion of the stem 203*a* located inside the container body 202. The container main body 210 and the discharger 203 constitute a discharge container main body which discharges the contents stored in the container main body 210 from the stem 203*a*. In the shown example, an aerosol can in which liquid contents are contained is adopted as the discharge container main body.

When the stem 203*a* is pushed down with respect to the container body 202, the discharge valve opens, and the contents in the container body 202 pass through the stem 203*a* and are discharged from an upper end portion of the stem 230*a*. At this time, in the embodiment, the liquid contents in the container body 202 are discharged from the upper end portion of the stem 203*a* in a foamy form. When the pushing down of the stem 203*a* is released, the stem 203*a* is moved upward by an upward pushing force acting on the stem 203*a* and the discharge valve is closed, and the discharge of the contents is stopped. The contents discharged from the stem 203*a* may not be foamy.

The fixing member 213 is fixed to the mouth portion 210*a* of the container main body 210 to surround the stem 203*a* from the outside in the radial direction. The fixing member 213 is fixed to the mouth portion 210*a* of the container body 210 not to be rotatable around the container axis O and not to be movable upward. The fixing member 213 includes an outer cylindrical portion 221 fitted into the mouth portion 210*a* of the container main body 210 from the outer side in the radial direction via the top wall plate 217, an annular coupling portion 223 extending toward the inside in the radial direction from an upper end portion of the outer cylindrical portion 221, an inner cylindrical portion 222 extending downward from an inner circumferential edge of the coupling portion 223, an annular receiving portion 254 extending toward the inside in the radial direction from a lower end portion of the inner cylindrical portion 222, and an external conversion cylindrical portion 255 extending upward from an inner circumferential edge of the receiving portion 254.

A fitting protrusion portion 221*c* protruding toward the inside in the radial direction is formed at a lower end portion of the outer cylindrical portion 221. In the embodiment, a plurality of fitting protrusion portions 221*c* are formed at intervals in the circumferential direction (refer to FIG. 26). The fitting protrusion portion 221*c* is undercut-fitted to an outer circumferential edge portion of the top wall plate 217, and the outer cylindrical portion 221 is caulked from the outer side in the radial direction to the mouth portion 210*a*, and thus rotation of the fixing member 213 about the container axis O and upward movement of the fixing member 213 are restricted. In a plan view, the outer cylindrical portion 221 has a perfect circular shape that is coaxial with the container axis O. A flange portion 221*a* protruding toward the outside in the radial direction is formed in a central portion of the outer cylindrical portion 221 in the direction of the container axis O. A surrounding cylindrical portion 221*b* extending downward is formed at an outer circumferential edge of the flange portion 221*a*.

A spring 253 (pushing member) such as a metallic coil spring is disposed between the external conversion cylindrical portion 255 and the inner cylinder portion 222. The spring 253 is disposed between the container body 202 and the inner plate 215 in the direction of the container axis O. When the inner plate 215 is located at a discharge position that will be described later, a lower end portion of the spring 253 is in contact with the receiving portion 254 in a state that the spring 253 is compressed state, and an upper end portion of the spring 253 is in contact with a plate main body 230 of the inner plate 215. Accordingly, the spring 253 pushes the inner plate 215 located at the discharge position upward. When the metallic coil spring is used as the pushing member, a sufficient upward pushing force can be imparted to the inner plate 215, and the contents in a diffusion chamber 234 which will be described later can reliably be pushed out to a shaping surface (discharge surface) 227.

The coupling portion 223 connects upper end portions of the inner cylindrical portion 222 and the outer cylindrical portion 221 to each other. The coupling portion 223 is disposed above the mouth portion 210*a* of the container main body 210. A through-hole 223*a* passing through the coupling portion 223 in the direction of the container axis O is formed in the coupling portion 223. In the embodiment, a plurality of through-holes 223*a* are formed at regular intervals in the circumferential direction (refer to FIG. 26). A fitting cylinder portion 223*b* extending upward is formed at an outer circumferential edge of the coupling portion 223. The fitting cylindrical portion 223*b* is located on the outside of the outer cylindrical portion 221 in the radial direction and is located on the inside of the surrounding cylindrical portion 221*b* in the radial direction. A fitted portion 223*c* protruding toward the outside in the radial direction is formed over the entire circumference on an outer circumferential surface of the fitting cylinder portion 223*b*. The inner cylindrical portion 222 is located in the annular concave portion 218 of the top wall plate 217 and is fixed from the inside in the radial direction to an outer circumferential surface of the annular concave portion 218 that faces the inside in the radial direction.

(Inner Plate)

The inner plate 215 includes a plate-shape plate main body 230 extending in a plane orthogonal to the container axis O, and a guide cylinder 231 and an internal conversion cylindrical portion 232 which are coaxial with the container axis O extending downward from the plate main body 230. The internal conversion cylindrical portion 232 is disposed on the outside of the guide cylinder 231 in the radial direction. A lower end portion of the internal conversion cylindrical portion 232 is located lower than a lower end portion of the guide cylinder 231.

The plate main body 230 is fitted into the exterior portion 214, and the outer circumferential edge of the plate main body 230 slides on the inner circumferential surface of the exterior portion 214 in the direction of the container axis O. The plate main body 230 is brought into contact with or becomes close to the supply surface 228 facing downward in the top wall portion 224 of the exterior portion 214 by the upward pushing force of the spring 253. In a plan view, the plate main body 230 and the supply surface 228 are formed to have the same shape and the same size as each other. A communication hole 233 passing through the plate main body 230 in the direction of the container axis O is formed in the plate main body 230. The communication hole 233 is disposed coaxially with the container axis O. An inner diameter of the communication hole 233 is smaller than an outer diameter of the stem 203*a*.

An inner diameter of the guide cylinder 231 is larger than the outer diameter of the stem 203*a*. A diameter of a lower end portion of the inner circumferential surface of the guide cylinder 231 gradually expands as it goes downward. Therefore, when the inner plate 215 moves down, the stem 203*a* smoothly enters the guide cylinder 231. An outer diameter of the internal conversion cylindrical portion 232 is smaller than an inner diameter of the external conversion cylindrical portion 255. The internal conversion cylindrical portion 232 is disposed on the inside of the external conversion cylindrical portion 255. A lower end portion of the internal conversion cylindrical portion 232 is located at a center portion of the external conversion cylindrical portion 255 in the direction of the container axis O.

Figure 24:
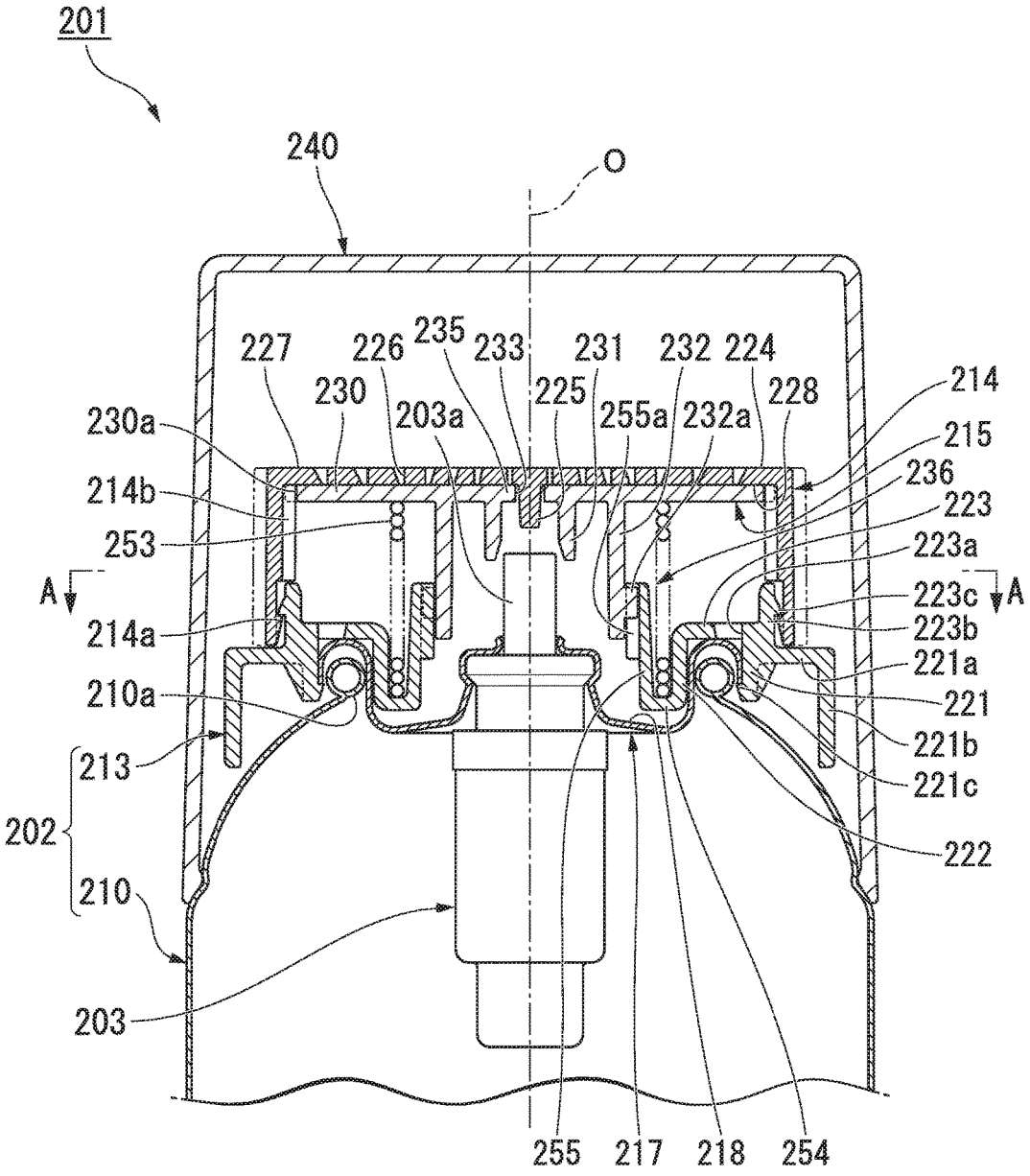
FIG. 24 is a longitudinal cross-sectional view of a discharge container according to a fourth embodiment, and shows a state in which the inner plate is located at the standby position.

The inner plate 215 is disposed in the exterior portion 214 to be movable downward in the state where the inner plate 215 is pushed upward. The inner plate 215 moves in the vertical direction between an upper standby position (refer to FIG. 24) at which the inner plate 215 is in contact with or close to the supply surface 228 and a lower discharge position (refer to FIG. 28) at which the inner plate 215 is separated downward from the supply surface 228 and forms the diffusion chamber 234 between the inner plate 215 and the exterior portion 214. As shown in FIG. 24, when the inner plate 215 is located at the standby position, a core body 225 is inserted into the communication hole 233, and a lower end portion of the guide cylinder 231 is inserted into the upper end portion of the stem 203*a*.

Figure 28:
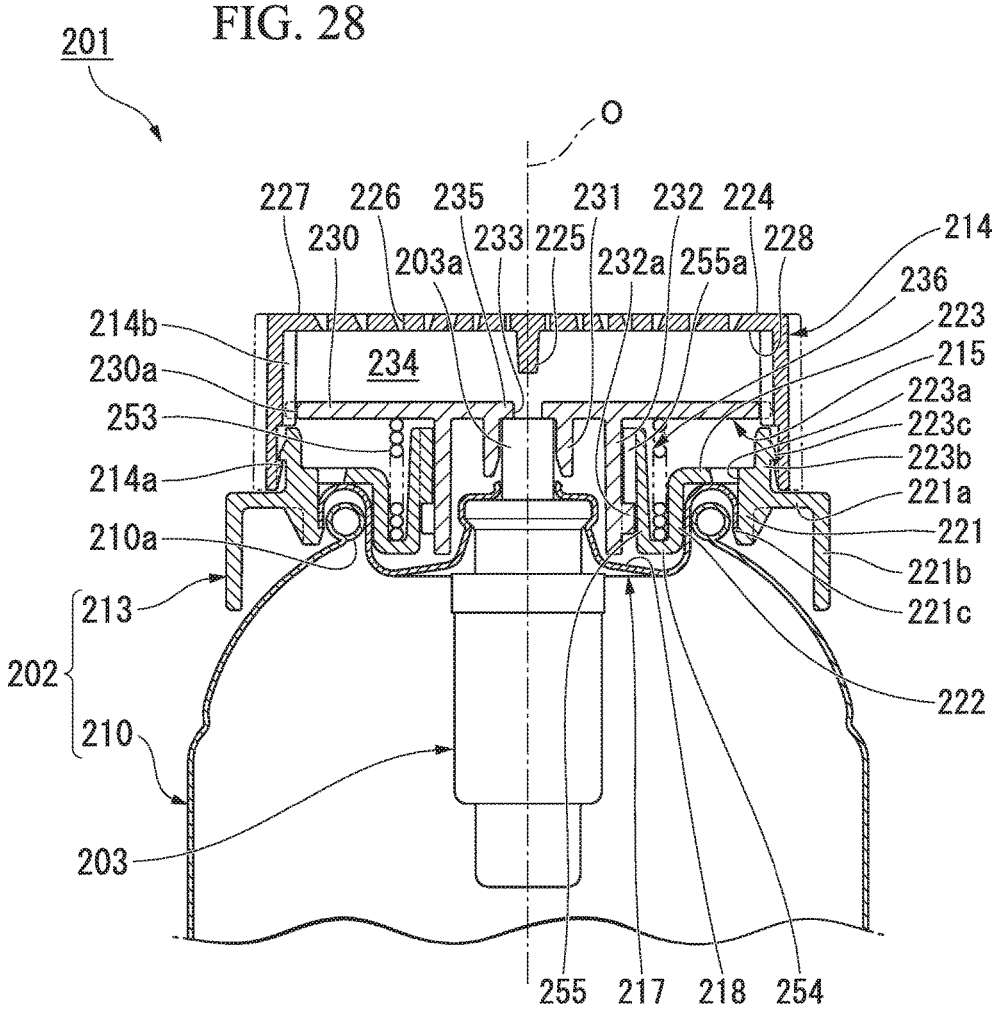
FIG. 28 is a longitudinal cross-sectional view of the discharge container of FIG. 24, and shows a state in which the inner plate is located at the discharge position.

As shown in FIG. 28, when the inner plate 215 is located at the discharge position, an opening circumferential edge portion (hereinafter, referred to as a locking portion 235) of the communication hole 233 in the plate main body 230 is locked to the stem 203*a*. The locking portion 235 is in contact with the upper end edge of the stem 203*a* from the upper side and moves down the stem 203*a* as the inner plate 215 moves down. At this time, the communication hole 233 communicates the inside of the stem 203*a* with the diffusion chamber 234. Further, at this time, the plate main body 230 of the inner plate 215 is located below the core body 225, and the core body 225 is located in the diffusion chamber 234.

The diffusion chamber 234 is disposed coaxially with the container axis O. The diffusion chamber 234 is formed in a flat shape that is larger in the radial direction than in the direction of the container axis O. The diffusion chamber 234 is defined by the top wall portion 224 and the circumferential wall portion of the exterior portion 214 and the plate main body 230 of the inner plate 215. Accordingly, a part of the wall surface of the diffusion chamber 234 is formed by the supply surface 228. Since the diffusion chamber 234 is provided, it is possible to prevent the contents from being disproportionally discharged from a specific portion among a plurality of molding holes 226 (described later) of the exterior portion 214. Thus, it is possible to accurately form a shaped piece formed by each of the molding holes 226. Therefore, the molded object can be formed with high accuracy.

(Exterior Portion)

The top wall portion 224 of the exterior portion 214 is disposed above the stem 203*a*. The top wall portion 224 is formed in a plate shape orthogonal to the container axis O. A convex portion 214*b* protruding toward the inside in the radial direction is formed on an inner circumferential surface of the circumferential wall portion of the exterior portion 214. In the embodiment, a plurality of convex portions 214*b* extend in the direction of the container axis O and are formed at intervals in the circumferential direction. The concave portion 230*a* formed in the outer circumferential edge of the plate main body 230 of the inner plate 215 is engaged with the convex portion 214*b*, whereby rotation of the plate main body 230 about the container axis O with respect to the exterior portion 214 is restricted. Therefore, the exterior portion 214 and the inner plate 215 are rotatable integrally around the container axis O. In the shown example, a pair of convex portions 214*b* are provided at positions facing each other with the container axis O interposed between the positions, and a pair of concave portions 230*a* are also provided at positions facing each other with the container axis O interposed between the positions. Therefore, it is possible to securely rotate the exterior portion 214 and the inner plate 215 integrally. A constitution for integrally rotating the exterior portion 214 and the inner plate 215 is not limited to the convex portion 214*b* and the concave portion 230*a*. For example, the number of convex portions 214*b* and concave portions 230*a* may be appropriately changed. Alternatively, a concave portion may be formed in the exterior portion 214, and a convex portion engaging with the concave portion may be formed on the inner plate 215.

A fitting portion 214*a* protruding toward the inside in the radial direction is formed at the lower end portion of the circumferential wall portion of the exterior portion 214. The fitting portion 214*a* is undercut-fitted to the fitted portion 223*c* of the fixing member 213. Therefore, the upward movement of the exterior portion 214 with respect to the fixing member 213 is restricted. Further, a lower end opening edge of the exterior portion 214 is in contact with or close to the flange portion 221*a* of the fixing member 213 from the upper side. Accordingly, the downward movement of the exterior portion 214 with respect to the fixing member 213 is restricted.

The core member 225 extending downward from the top wall portion 224 and the molding hole 226 passing through the top wall portion 224 in the direction of the container axis O are formed in the exterior portion 214. The core body 225 is formed in a solid bar shape or column shape and disposed coaxially with the container axis O. The core body 225 is located above the stem 203*a* and faces the inside of the upper end portion of the stem 203*a* in the direction of the container axis O. A diameter of the core body 225 gradually decreases as it goes toward the lower side. An outer diameter of the upper end portion of the core body 225 is smaller than an inner diameter of the stem 203*a* and an inner diameter of the communication hole 233. The core body 225 is inserted into the communication hole 233.

Figure 25:
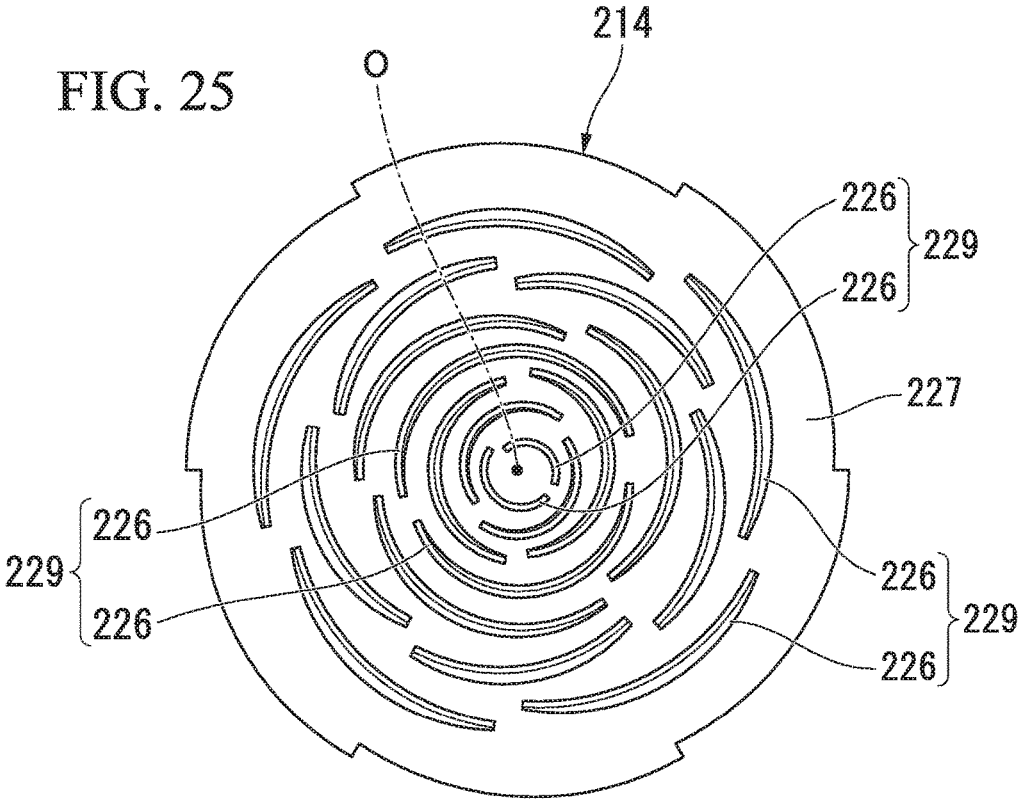
FIG. 25 is a plan view of the exterior portion of FIG. 24.

The plurality of molding holes 226 are formed in the exterior portion 214. The plurality of molding holes 226 are respectively open to the shaping surface 227 of the top wall portion 224 directed upward and the supply surface 228 of the top wall portion 224 directed downward. The contents are discharged onto the shaping surface 227 through the plurality of molding holes 226. The shaping surface 227 and the supply surface 228 extend in a direction orthogonal to the container axis O. As shown in FIG. 25, the molding hole 226 is formed in a long hole shape which extends in the circumferential direction. The plurality of molding holes 226 are disposed at intervals in the circumferential direction and the radial direction. In the embodiment, the plurality of molding holes 226 disposed at intervals in the circumferential direction form a hole array 229, and these hole arrays 229 are disposed at multiple positions around the container axis O. The hole arrays 229 are disposed to surround the core body 225 from the outside in the radial direction in a plan view.

When the contents pass through each of the hole arrays 229, a plurality of shaped pieces are formed on the shaping surface 227. Then, these shaped pieces are combined on the shaping surface 227, and thus a molded object is formed. For the molded objects, a shape such as flowers like a rose and a sunflower, characters, logotypes and so on can be formed. The shape of the molded object to be shaped can be changed by appropriately changing the number and shape of the molding holes 226. Further, the number and shape of the molding holes 226 may be appropriately changed according to the application of the contents to be discharged and so on.

(Conversion Mechanism)

As shown in FIG. 24, the discharge container 201 of the embodiment includes a conversion mechanism 236 which converts a rotating motion of the exterior portion 214 and the inner plate 215 around the container axis O with respect to the container body 202 into a motion of the inner plate 215 in the direction of the container axis O. The conversion mechanism 236 includes a sliding protrusion portion 232*a* provided on one of the inner plate 215 and the container body 202, and a guide protrusion portion 255*a* provided on the other one of the inner plate 215 and the container body 202.

In the shown example, the sliding protrusion portion 232*a* protrudes toward the outside in the radial direction from an outer circumferential surface of the internal conversion cylindrical portion 232, and the guide protrusion portion 255*a* protrudes toward the inside in the radial direction from an inner circumferential surface of the external conversion cylindrical portion 255 of the container body 202. The guide protrusion portion 255*a* is formed from an upper end portion of the external conversion cylindrical portion 255 to a center portion of the external conversion cylindrical portion 255 in the direction of the container axis O. An upper end portion of the sliding protrusion portion 232*a* is located lower than the upper end portion of the guide protrusion portion 255*a*.

Figure 27:
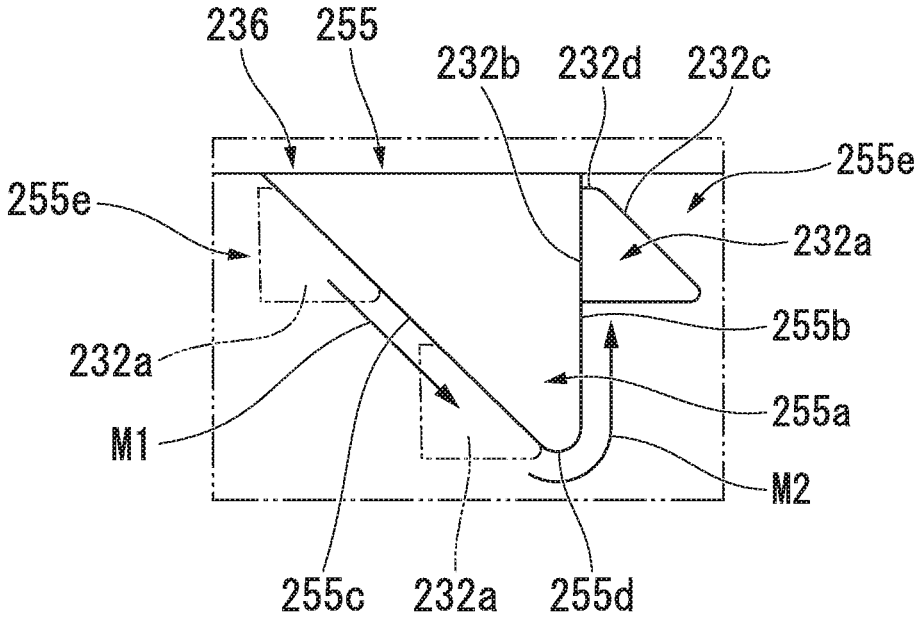
FIG. 27 is an exploded view of a conversion mechanism of FIG. 24.

FIG. 27 shows a state in which the conversion mechanism 236 is deployed in the circumferential direction. As shown in FIG. 27, the guide protrusion portion 255*a* includes a first vertical surface 255*b* which extends in the direction of the container axis O, and a first inclined surface 255*c* which gradually separates from the first vertical surface 255*b* toward one side in the circumferential direction as it goes upward from a lower end portion of the first vertical surface 255 *b*, and the guide protrusion portion 255*a* is formed in a substantially triangular shape which protrudes downward. A lower end of the first vertical surface 255*b* and a lower end of the first inclined surface 255*c* are connected by a curved surface 255*d* protruding downward.

As shown in FIG. 27, the sliding protrusion portion 232*a* includes a second vertical surface 232*b* which extends in the direction of the container axis O, and a second inclined surface 232*c* which is gradually separated from the second vertical surface 232*b* toward the other side in the circumferential direction as it goes downward from an upper end of the second vertical surface 232*b*, and the sliding protrusion portion 232*a* is formed in a substantially triangular shape which protrudes upward. An upper end portion of the second inclined surface 232*c* is a curved surface 232*d* protruding upward. The sliding protrusion portion 232*a* is smaller than the guide protrusion 255*a* as a whole and is formed in a shape approximately similar to that of the guide protrusion portion 255*a*. An angle formed by the first vertical surface 255*b* and the first inclined surface 255*c* and an angle formed by the second vertical surface 232*b* and the second inclined surface 232*c* are the same as each other.

Rotation of the inner plate 215 in the clockwise direction (to the other side in the circumferential direction) with respect to the container body 202 in a plan view is allowed by the first inclined surface 25 *c* and the second inclined surface 232*c*. Further, rotation of the inner plate 215 in counterclockwise direction (to one side in the circumferential direction) with respect to the container body 202 in a plan view is restricted by the first vertical surface 255*b* and the second vertical surface 232*b* and by the upward pushing force applied to the inner plate 215 by the spring 253. As described above, the sliding protrusion portion 232*a*, the guide protrusion portion 255*a*, and the spring 253 constitute a ratchet mechanism which allows the inner plate 215 to rotate about the container axis O only in one direction with respect to the container body 202. The ratchet mechanism may be formed to allow clockwise rotation of the inner plate 215 with respect to the container body 202 in a plan view and to restrict counterclockwise rotation thereof.

Figure 3:
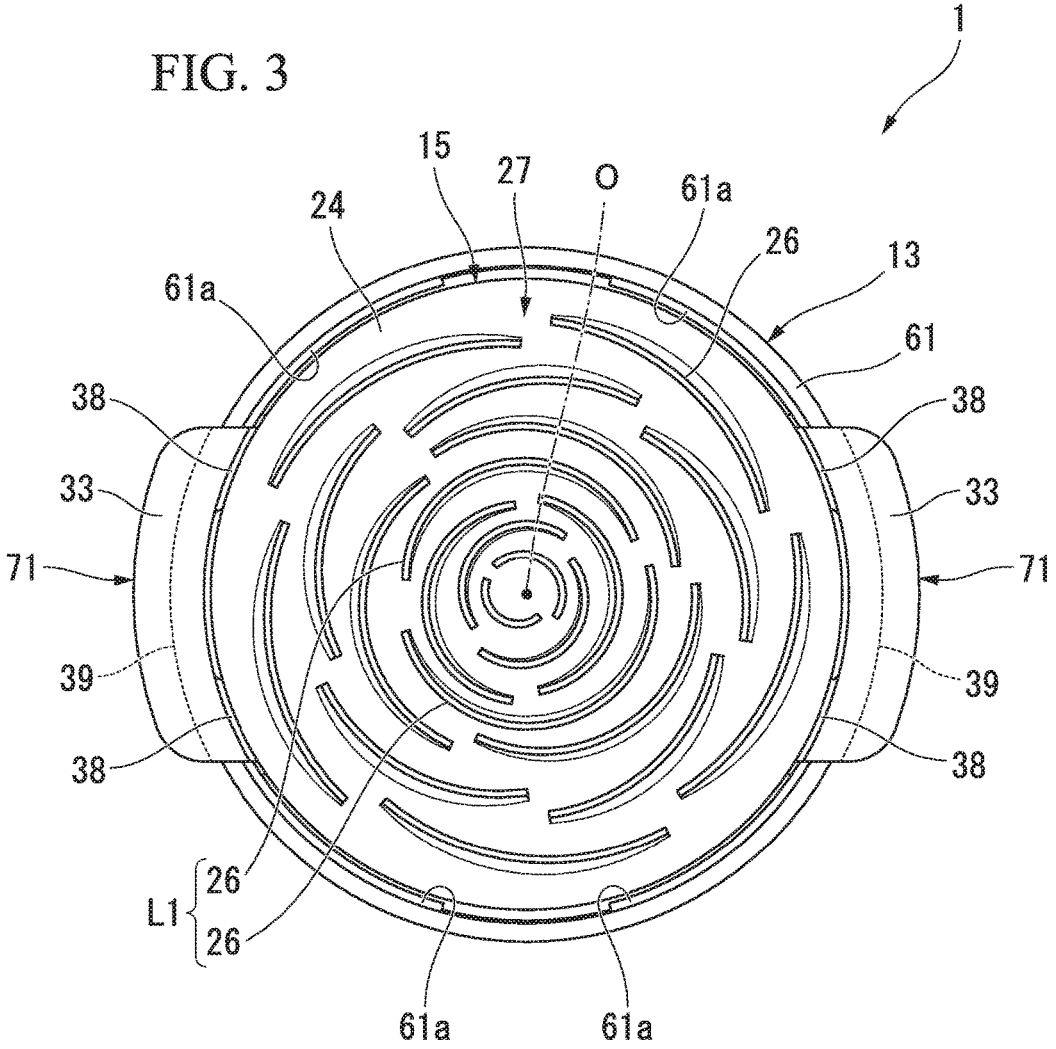
FIG. 3 is a top view of the discharge container shown in FIG. 1.
Figure 26:
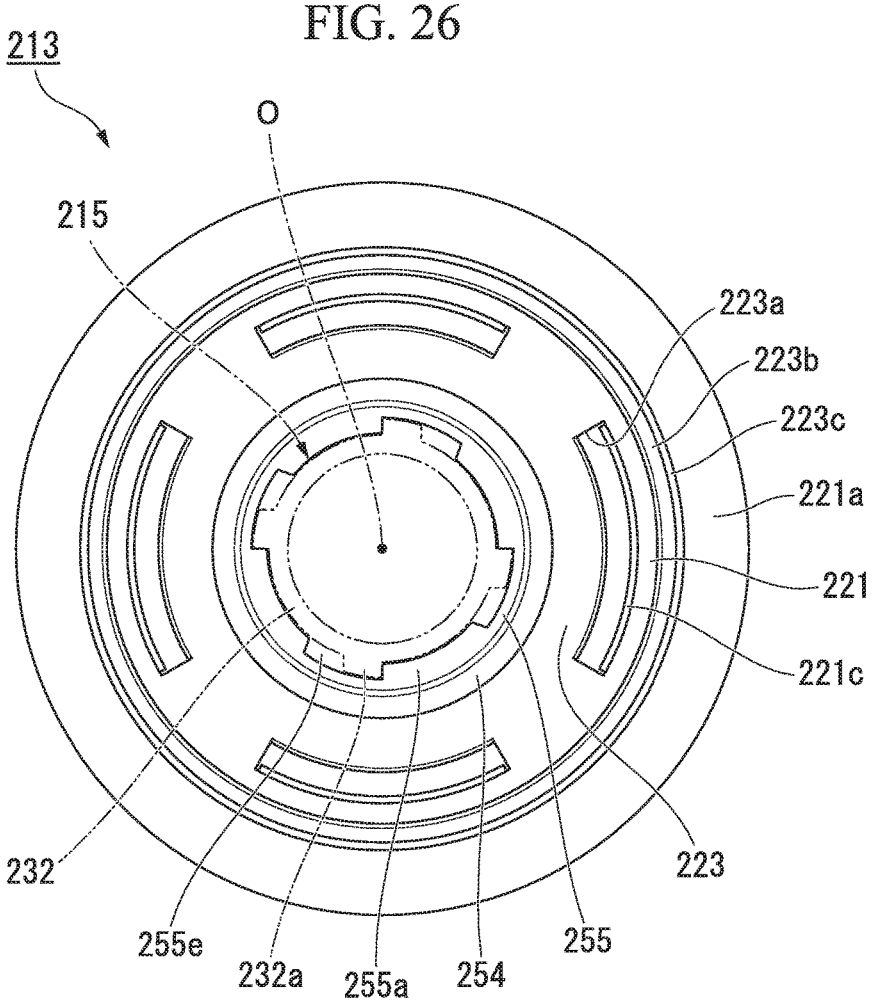
FIG. 26 is a plan view of the fixing member of FIG. 24.

FIG. 26 is a plan view of the fixing member 213, and a shape of the inner plate 215 seen downward from a cutting line A-A shown in FIG. 24 is indicated by an alternating two-dots-dashed line. In the embodiment, as shown in FIG. 3, a plurality of guide protrusion portions 255*a* are formed on the inner circumferential surface of the external conversion cylindrical portion 255 at regular intervals in the circumferential direction. Therefore, a relief portion 255*e* is provided on the inner circumferential surface of the external conversion cylindrical portion 255 to avoid the guide protrusion portion 255*a*. The relief portion 255*e* is disposed adjacent to the guide protrusion portion 255*a* in the circumferential direction. The width of the relief portion 255*e* in the circumferential direction is larger than the width of the sliding protrusion portion 232*a* in the circumferential direction. Therefore, in a state in which the sliding protrusion portion 232*a* is located in the relief portion 255*e*, a space in the circumferential direction is generated between the sliding protrusion portion 232*a* and the guide protrusion portion 255*a*. As a result, when an excessively large rotational force is applied to the inner plate 215, for example, the sliding protrusion portion 232*a* continuously crosses the plurality of guide protrusion portions 255*a* in the circumferential direction, and thus it is possible to prevent the contents from being continuously discharged. In the embodiment, the plurality of sliding protrusion portions 232*a* are formed on the outer circumferential surface of the internal conversion cylindrical portion 232 at regular intervals in the circumferential direction. The number (four in the shown example) of sliding protrusion portions 232*a* is the same as the number of guide protrusion portions 255*a*. The number of sliding protrusion portions 232*a* may not be the same as that of the guide protrusion protrusions 255*a* and, for example, may be less than the number of guide protrusion portions 255*a*.

As shown in FIG. 26, in a plan view, in a state in which an end portion of the sliding protrusion portion 232*a* on one side in the circumferential direction and an end portion of the guide protrusion portion 255*a* on the other side in the circumferential direction are close to each other, an inclination of these end portions substantially coincides with each other. Similarly, when an end portion of the sliding protrusion portion 232*a* on the other side in the circumferential direction and an end portion of the guide protrusion portion 255*a* on one side in the circumferential direction come close to each other, the inclination of these both end portions substantially coincide with each other. Therefore, it is possible to increase a contact area between the first vertical surface 255*b* and the second vertical surface 232*b* and a contact area between the first inclined surface 255*c* and the second inclined surface 232*c*.

Next, the operation of the discharge container 201 constituted as described above will be described.

In the initial state before the operation, the inner plate 215 is located at the standby position shown in FIG. 24. When the contents are discharged, the exterior portion 214 is rotated from the initial state around the container axis O toward the other side in the circumferential direction with respect to the container body 202. At this time, the inner plate 215 rotates integrally with the exterior portion 214 around the container axis O with respect to the fixing member 213, and the first inclined surface 255*c* and the second inclined surface 232*c* are brought into contact with each other in the circumferential direction. When the exterior portion 214 is further rotated, the sliding protrusion portion 232*a* moves down along the first inclined surface 255*c* as indicated by an arrow M1 in FIG. 27. Therefore, the inner plate 215 moves down against the upward pushing force of the spring 253, and the locking portion 235 formed on the inner plate 215 moves down the stem 203*a*, and the diffusion chamber 234 is formed between the inner plate 215 and the exterior portion 214.

As shown in FIG. 28, as the stem 203*a* moves down, the contents discharged from the upper end portion of the stem 203*a* are supplied to the diffusion chamber 234 through the communication hole 233. The contents are discharged upward from the communication hole 233, supplied to the core body 225, flow on the outer circumferential surface of the core body 225 in the direction of the container axis O, and are held by the core body 225. At this time, for example, the contents are held by the core body 225 to form a circular shape centering on the core body 225 in a plan view. When the amount of contents supplied to the core body 225 increases as the amount of the contents discharged from the stem 203*a* increases, the contents enlarge on the core body 225 and gradually expand toward the outside in the radial direction. Therefore, in conjunction with the fact that the diffusion chamber 234 is formed to be flattened as described above, the contents supplied into the diffusion chamber 234 diffuse in the radial direction and are supplied from the supply surface 228 to the plurality of molding holes 226. The contents that have passed through the plurality of molding holes 226 are discharged onto the shaping surface 227 to form a plurality of shaped pieces, and thus the respective shaped pieces are combined to form the molded object.

When the exterior portion 214 is further rotated, as indicated by an arrow M2 in FIG. 27, the sliding protrusion portion 232*a* reaches the lower end portion of the first inclined surface 255*c* of the guide protrusion portion 255*a*, climbs over the lower end portion in the circumferential direction, and reaches the relief portion 255*e*. Since the upward movement of the sliding protrusion portion 232*a* is allowed in the relief portion 255*e*, the inner plate 215 is moved upward to the standby position by the upward pushing force of the spring 253. Therefore, the locking of the stem 203*a* by the locking portion 235 is released, the stem 203*a* moves upward, the discharge of the contents from the stem 203*a* is stopped, and the contents in the diffusion chamber 234 are pushed out to the shaping surface 227. Further, when the contents are discharged again, the above-described action is repeated by performing the operation of rotating the exterior portion 214 again, and thus the contents can be repeatedly discharged.

As described above, according to the discharge container 201 of the embodiment, it is possible to discharge the contents from the stem 203*a* and to stop the discharge to restore and displace the inner plate 215 to the standby position by rotating the exterior portion 214 around the container axis O with respect to the container body 202. Therefore, for example, when comparing with a case in which the contents are discharged from the stem 203*a* by pushing down the inner plate 215 with the hand, an operating force is reduced, the discharge amount of the contents is stabilized, and the flow of the contents discharged onto the shaping surface 227 while the contents are being discharged from the stem 203*a*, and the flow of the contents discharged to the shaping surface 227 while the discharge from the stem 203*a* is stopped and the contents in the diffusion chamber 234 are pushed out to the shaping surface 227 are continuous. Accordingly, it is possible to shape the molded object with high accuracy.

Further, the receiving portion 254 for receiving an elastic force of the spring 253 extends toward the inside in the radial direction from the inner cylindrical portion 222 fixed in the annular concave portion 218 of the top wall plate 217, and the external conversion cylindrical portion 255 including the guide protrusion portion 255*a* extends upward from the inner circumferential edge of the receiving portion 254. Due to such a constitution, since the rigidity of the receiving portion 254 and the external conversion cylindrical portion 255 is increased and deformation or displacement of the external conversion cylindrical portion 255 is minimized by the elastic force of the spring 253, it is possible to stabilize a positional relationship between the guide protrusion portion 255*a* and the sliding protrusion portion 232*a*. Therefore, it is possible to reliably achieve excellent actions and effects with the guide protrusion portion 255*a* and the sliding protrusion portion 232*a* as described above, and the spring 253 and the external conversion cylindrical portion 255 can be disposed compactly inside the mouth portion 210*a* of the container main body 210.

Further, the angle formed by the first vertical surface 255*b* and the first inclined surface 255*c* of the guide protrusion portion 255*a* and the angle formed by the second vertical surface 232*b* and the second inclined surface 232*c* of the sliding protrusion portion 232*a* are the same as each other. Therefore, it is possible to increase the contact area between the first inclined surface 255*c* and the second inclined surface 232*c* when the sliding protrusion portion 232*a* slides on the guide protrusion portion 255*a* in the circumferential direction. Thus, for example, when the sliding protrusion portion 232*a* and the guide protrusion portion 255*a* slide, both of the sliding protrusion portion 232*a* and the guide protrusion portion 255*a* are prevented from being worn so that the sliding of them can be stabilized. Due to the fact that the angles of the first inclined surface 255*c* and the second inclined surface 232*c* are the same as each other and due to the fact that the plurality of guide protrusion portions 255*a* and the plurality of sliding protrusion portions 232*a* are provided at intervals in the circumferential direction, the central axis of the inner plate 215 is prevented from rotating to become inclined with respect to the container axis O during the operation, and the inner plate 215 can be smoothly rotated with respect to the container body 202 without being caught by the container body 202.

Further, the guide protrusion portion 255*a* has the vertical surface 255*b* extending in the direction of the container axis O, and the sliding protrusion portion 232*a* has the vertical surface 232*b* extending in the direction of the container axis O. Accordingly, rotation of the exterior portion 214 and the inner plate 215 around the container axis O with respect to the container body 202 is allowed only in one direction, and the sliding protrusion portion 232*a* which has reached the relief portion 255*e* can be promptly moved upward by the upward pushing force of the spring 253. Therefore, it is possible to improve the operability when the exterior portion 214 is rotated with respect to the container body 202, and it is also possible to stabilize the speed and amount of the contents discharged onto the shaping surface 227. Thereby, it is possible to improve the accuracy in the shaping of the molded object. In addition, the guide protrusion portion 255*a* has the curved surface 255*d* protruding downward, and the sliding protrusion portion 232*a* has a curved surface 232*d* protruding upward. Accordingly, the sliding protrusion portion 232*a* can smoothly climb over the guide protrusion portion 255*a* in the circumferential direction.

The technical scope of the present invention is not limited to the fourth embodiment, and various modifications can be made without departing from the spirit of the present invention.

For example, in the fourth embodiment, the sliding protrusion portion 232*a* is provided on the inner plate 215 and the guide protrusion portion 255*a* is provided on the fixing member 213, but the present invention is not limited thereto. For example, the sliding protrusion portion 232*a* may be provided on the fixing member 213, and the guide protrusion portion 255*a* may be provided on the inner plate 215. Further, in the fourth embodiment, the guide protrusion portion 255*a* is provided on the fixing member 213 fixed to the container body 202 and indirectly provided on the container body 202, but the present invention is not limited thereto. For example, the guide protrusion portion 255*a* may be formed integrally with the mouth portion 210*a* of the container body 210 and may be directly provided on the container body 202.

Further, the sliding protrusion portion 232*a* and the guide protrusion portion 255*a* are not limited to the example of the fourth embodiment, and various types can be adopted. For example, in the fourth embodiment, the four sliding protrusion portions 232*a* and the four guide protrusion portions 255*a* are provided, but the present invention is not limited thereto. For example, only one sliding protrusion portion 232*a* and only one guide protrusion portion 255*a* may be provided. In this case, one relief portion 255*e* may be provided in a C shape in a plan view, and both end portions of the relief portion 255*e* may sandwich the guide protrusion portion 255*a* in the circumferential direction. The angle formed by the first inclined surface 255*c* and the first vertical surface 255*b* and the angle formed by the second inclined surface 232*c* and the second vertical surface 232*b* may not be the same as each other. Further, the sliding protrusion portion 232*a* may be formed in a columnar shape extending toward the inside in the radial direction from the internal conversion cylindrical portion 232.

In addition, in the fourth embodiment, the ratchet mechanism that allows rotation of the exterior portion 214 and the inner plate 215 around the container axis O with respect to the container body 202 only in one direction is adopted, but the present invention is not limited thereto. For example, the exterior portion 214 and the inner plate 215 may be provided to be integrally rotatable in both directions around the container axis O with respect to the container body 202.

Also, without departing from the spirit of the present invention, it is possible to appropriately replace the elements in the above-described embodiment with well-known elements, and the above-described embodiment and modified examples may be appropriately combined.

INDUSTRIAL APPLICABILITY

According to the present invention, it is possible to provide a discharge container capable of easily detaching a fixing member from a container main body, minimizing variation in a discharge amount of the contents discharged onto a discharge surface at each position, and forming a molded object on the discharge surface (shaping surface) with high accuracy while improving operability.

REFERENCE SIGNS LIST

1, 2 Discharge container
12 Container main body
12*a* Mouth portion
13 Fixing member
14 Discharger
15 Exterior portion
15*a* Circumferential wall portion
15*b* Lower engaging portion
16 Inner plate
19 Stem
24 Top wall portion
26 Molding hole
27 Discharge surface
28 Supply surface
29 Insertion hole
30 Inner plate main body
35 Diffusion chamber
36 Locking portion
61 Surrounding cylinder
61*a* Upper engaging portion
62 Connecting portion
63 Outer fitting cylinder
71 Pushing-down portion
80 Discharge hole
110 Discharge container
111 Container main body
112 Discharger
113 Fixing member
114 Exterior portion
115 Mouth portion
118 Stem
125 Outer fitting cylinder
126 Surrounding cylinder
129 Upper engaging portion
133 Top wall portion
134 Circumferential wall portion
136 Molding hole
138 Discharge surface
139 Supply surface
145 Locking portion
151 Diffusion chamber
152 Lower engaging portion
153 First guide surface
154 Second guide surface
155 Guide protrusion
157, 158 Restricting surface
180 Discharge hole
201 Discharge container
202 Container body
203 Discharger
210 Container main body
210*a* Mouth portion
213 Fixing member
214 Exterior portion
215 Inner plate
217 Top wall plate
218 Annular concave portion
203*a* Stem
222 Inner cylindrical portion
224 Top wall portion
226 Molding hole
227 Shaping surface
228 Supply surface
230 Plate main body
232 Internal conversion cylindrical portion
232*a* Sliding protrusion portion
232*b* Second vertical surface
232*c* Second inclined surface
233 Communication hole
234 Diffusion chamber
235 Locking portion
253 Spring (pushing member)
254 Receiving portion
255 External conversion cylindrical portion
255*a* Guide protrusion
255*b* First vertical surface
255*c* First inclined surface

255*e* Relief portion
280 Discharge hole
O Container axis

The invention claimed is:

1. A discharge container comprising:

a container main body in which contents are stored;

a fixing member attached to a mouth portion of the container main body;

a discharger including a stem provided upright in the mouth portion of the container main body to be movable downward in a state where the stem is pushed upward;

an exterior portion including a top wall portion which is disposed above the stem and through which a molding hole passes in a vertical direction, and the exterior portion configured to discharge the contents from the discharge hole to a discharge surface of the top wall portion facing upward; and an inner plate provided in the exterior portion to be movable and configured to form a diffusion chamber between the inner plate and a supply surface of the top wall portion that faces downward, the diffusion chamber configured to diffuse the contents from the stem in a radial direction and supply the contents to the molding hole, wherein the fixing member includes an outer fitting cylinder externally fitted to the mouth portion of the container main body, a surrounding cylinder surrounding the outer fitting cylinder from an outer side in the radial direction, and a plurality of connecting portions connecting the outer fitting cylinder with the surrounding cylinder and disposed with a gap in a circumferential direction, and the gap passes through the fixing member in a vertical direction, the exterior portion includes a circumferential wall portion extending downward from the top wall portion and is inserted into a space between the outer fitting cylinder and the surrounding cylinder of the fixing member, a lower engaging portion, which is engaged with an upper engaging portion formed on an inner circumferential surface of the surrounding cylinder from a lower side of the upper engaging portion, is formed on an outer circumferential surface of the circumferential wall portion, a locking portion, which is configured to be locked to the stem and to move down the stem as the inner plate moves downward, and a pushing-down portion, which protrudes toward an outside in the radial direction and is disposed on an outside of the exterior portion through an insertion hole formed in the circumferential wall portion of the exterior portion, are provided at the inner plate, and the lower engaging portion is disposed on an outer circumferential surface of the circumferential wall portion of the exterior portion at a position in the circumferential direction which avoids a position in the circumferential direction where the pushing-down portion is disposed, and protrudes toward the outside in the radial direction.

2. The discharge container according to claim 1, wherein the lower engaging portion extends in the circumferential direction and is divided by the insertion hole in the circumferential direction, and positions in the circumferential direction of both end portions of the pushing-down portion in the circumferential direction and positions in the circumferential of portions where the lower engaging portion and the upper engaging portion are engaged with each other are adjacent to each other.

3. The discharge container according to claim 1, wherein one of the plurality of connecting portions is disposed at a position which at least a part thereof overlaps the pressing-down portion in the vertical direction.

4. The discharge container according to claim 1, wherein the upper engaging portion is located inside a space between the connecting portions adjacent to each other in the circumferential direction in a plan view seen in the vertical direction.

5. A discharge container comprising:

an inner plate attached to an upper end portion of a stem provided upright in a mouth portion of a container main body to be movable downward in a state where the stem is pushed upward; and an exterior portion including a plurality of molding holes through which contents discharged from the upper end portion pass and a discharge surface in which the plurality of molding holes are open, the exterior portion configured to form a molded object by combining a plurality of shaped pieces on the discharge surface, the plurality of shaped pieces formed by the contents passing through the plurality of molding holes and being molded, wherein a diffusion chamber, which diffuses the contents discharged from the upper end portion in a radial direction along the discharge surface and supplies the contents to each of the plurality of molding holes, is configured to be provided between the inner plate and the exterior portion, the exterior portion includes a top wall portion disposed above the stem and through which the plurality of molding holes pass in a vertical direction, the inner plate is provided in the exterior portion to be movable in the vertical direction between an upper standby position where a supply surface of the top wall portion directed to a lower side is in contact with or close to the inner plate and a lower discharge position where the inner plate is separated downward from the supply surface and forms the diffusion chamber between the inner plate and the exterior portion, and a locking portion, which is configured to be locked to the stem when the inner plate is located at the discharge position and to move down the stem as the inner plate moves downward, is disposed on the inner plate.

6. A discharge container comprising:

a container main body in which contents are stored;

a fixing member attached to a mouth portion of the container main body;

a discharger including a stem provided upright in the mouth portion to be movable downward in a state where the stem is pushed upward; and an exterior portion including a top wall portion disposed above the stem and through which a discharge hole passes in a direction of a container axis, and the exterior portion attached to the fixing member and configured to discharge the contents from the discharge hole to a discharge surface of the top wall portion facing upward; and wherein the fixing member includes an outer fitting cylinder externally fitted to the mouth portion and a surrounding cylinder surrounding the outer fitting cylinder from an outer side in the radial direction, the exterior portion includes a circumferential wall portion which extending downward from the top wall portion and inserted into a space between the outer fitting cylinder and the surrounding cylinder, a lower engaging portion, which is engaged with an upper engaging portion formed on an inner circumferential surface of the surrounding cylinder from a lower side of the upper engaging portion, is formed on an outer circumferential surface of the circumferential wall portion, guide surfaces, which collide with and come into sliding contact with each other due to relative rotational movement of the exterior portion and the fixing member and move up the exterior portion with respect to the fixing member, are respectively formed at the fixing member and the circumferential wall portion, and a locking portion, which is configured to be locked to the stem and to move down the stem, and a diffusion chamber, which is disposed on an inside of the circumferential wall portion, a part of a wall surface of which is formed by a supply surface of the top wall portion directed to a lower side, and which is configured to diffuse the contents from the stem in a radial direction and supply the contents to the discharge hole, are provided at the exterior portion.

7. The discharge container according to claim 6, wherein the guide surfaces are integrally formed with the upper engaging portion and the lower engaging portion, respectively.

8. The discharge container according to claim 7, wherein a circumferential end portion of one of the upper engaging portion and the lower engaging portion includes a guide protrusion including a first guide surface as the guide surface and provided to protrude from the circumferential end portion in the direction of the container axis, and a circumferential end portion of the other one of the upper engaging portion and the lower engaging portion is a second guide surface as the guide surface.

9. The discharge container according to claim 6, wherein a pair of guide surfaces as the guide surfaces are provided on the fixing member and the circumferential wall portion to be located on opposite sides in the radial direction with the container axis interposed therebetween.

10. The discharge container according to claim 6, wherein restricting surfaces, which collide with each other in the circumferential direction due to the relative rotational movement of the exterior portion and the fixing portion, and are locked to each other, and restrict further rotational movement thereof, are formed at the fixing member and the circumferential wall portion, respectively, and when the exterior portion rotates toward one side with respect to the fixing member in the circumferential direction, the guide surfaces collide with each other, and when the exterior portion rotates toward the other side with respect to the fixing member in the circumferential direction, the restricting surfaces collide with each other.

11. A discharge container comprising:

a container body including a container main body in which contents are stored;

a discharger including a stem provided upright in a mouth portion of the container main body to be movable downward in a state where the stem is pushed upward;

an exterior portion including a top wall portion disposed above the stem and through which a molding hole passes in a direction of a container axis, the exterior portion configured to discharge the contents from the discharge hole to a discharge surface of the top wall portion facing upward; and an inner plate disposed in the exterior portion to be movable downward in a state where the inner plate is pushed upward, the inner plate configured to be movable in a vertical direction between an upper standby position where a supply surface of the top wall portion directed to a lower side is in contact with or close to the inner surface and a lower discharge position where the inner plate is separated downward from the supply surface and forms a diffusion chamber between the inner plate and the exterior portion, the diffusion chamber configured to diffuse the contents from the stem in a radial direction and supply the contents to the molding hole, wherein a locking portion, which is configured to be locked to the stem when the inner plate is located at the discharge position and to move down the stem as the inner plate moves downward, is formed on the inner plate, a pushing member, which pushes the inner plate located at the discharge position upward, is disposed between the container body and the inner plate, the exterior portion and the inner plate are provided to be integrally rotatable around the container axis with respect to the container body, and at one of the inner plate and the container body, a guide protrusion portion, on which a sliding protrusion portion provided on the other one of the inner plate and the container body slides in a circumferential direction around a center of the container axis and moves down the inner plate against an upward pushing force of the pushing member, and a relief portion, which is adjacent to the guide protrusion portion in the circumferential direction and allows the sliding protrusion portion having climbed over the guide protrusion portion in the circumferential direction to move upward, are provided.

12. The discharge container according to claim 11, wherein the container body includes an inner cylindrical portion fixed to the mouth portion of the container body, a receiving portion extending toward an inside from the inner cylindrical portion in the radial direction, and an external conversion cylindrical portion extending upward from an inner circumferential edge of the receiving portion, an internal conversion cylindrical portion, which extends downward in an inner side of the external conversion cylindrical portion in the radial direction, is formed at the inner plate, and the guide protrusion portion is provided at one of the external conversion cylindrical portion and the internal conversion cylindrical portion, and the sliding protrusion portion is provided at the other one of the external conversion cylindrical portion and the internal conversion cylindrical portion.

13. The discharge container according to claim 11, wherein the guide protrusion portion includes a first vertical surface extending in the direction of the container axis and a first inclined surface gradually separated from the first vertical surface toward one side in the circumferential direction as going upward from the first vertical surface, the sliding protrusion portion includes a second vertical surface extending in the direction of the container axial and a second inclined surface gradually separated from the second vertical surface toward the other side in the circumferential direction as going downward, and an angle formed by the first vertical surface and the first inclined surface and an angle formed by the second vertical surface and the second inclined surface are the same as each other.

* * * * *